United States Patent [19]

Takei et al.

[11] Patent Number: 4,835,080

[45] Date of Patent: May 30, 1989

[54] PHOTORECEPTOR HAVING PHOTOSENSITIVE LAYER COMPRISING A BROMINATED ANTHANTHRONE OF SPECIFIED X-RAY SPECTRUM

[75] Inventors: Yoshiaki Takei, Hachioji; Eiichi Kijima, Hino; Satoshi Goto; Hiroyuki Nomori, both of Hachioji, all of Japan

[73] Assignee: Konishiroku Photo Industry Co., Ltd., Tokyo, Japan

[21] Appl. No.: 59,955

[22] Filed: Jun. 9, 1987

Related U.S. Application Data

[63] Continuation-in-part of Ser. No. 920,120, Oct. 17, 1986, abandoned.

[30] Foreign Application Priority Data

Oct. 19, 1985 [JP] Japan ..... 60-233872
Oct. 19, 1985 [JP] Japan ..... 60-233873
Oct. 19, 1985 [JP] Japan ..... 60-233874

[51] Int. Cl.[4] ..... G03G 5/14; G03G 5/06
[52] U.S. Cl. ..... 430/58; 430/72
[58] Field of Search ..... 430/72, 58

[56] References Cited

U.S. PATENT DOCUMENTS 3,877,935 4/1975 Regeusburger ..... 430/72
4,148,638 4/1979 Ohta et al. ..... 430/58

*Primary Examiner*—J. David Welsh
*Attorney, Agent, or Firm*—Finnegan, Henderson, Farabow, Garrett, & Dunner

[57] ABSTRACT

There is disclosed a photoreceptor which comprises a brominated anthanthrone pigment represented by the structural formula shown below:

contained in the photosensitive layer, the brominated anthanthrone pigment exhibiting a X-ray diffraction spectrum having the respective diffraction strengths S (18.4°) and S (26.7°) at $2\theta = 18.4°$ and 26.7° which satisfy the relationship of $$0.2 \leqq S\ (18.4°)\ /\ S\ (26.7°) \leqq 1.0;$$

or exhibiting a X-ray diffraction spectrum having the respective half-value widths of diffraction strength of $\Delta\theta(18.4°)$ and $\Delta\theta(26.7°)$ at $2\theta = 18.4°$and 26.7° which satisfy the relationship of $$\{\Delta\theta(18.4°) \leqq 0.8°\}\ \text{and/or}$$

$$\{\Delta\theta(26.7°) \leqq 1°\}.$$

17 Claims, 5 Drawing Sheets

PHOTORECEPTOR HAVING PHOTOSENSITIVE LAYER COMPRISING A BROMINATED ANTHANTHRONE OF SPECIFIED X-RAY SPECTRUM

This application is a continuation-in part of our application Ser. No. 920,120, filed Oct. 17, 1986 now abandoned.

BACKGROUND OF THE INVENTION

This invention relates to a photoreceptor, particularly to an electrophotographic photoreceptor.

In the prior art, as electrophotographic photoreceptors, inorganic photoreceptors having photosensitive layers composed mainly of inorganic photosensitive materials such as selenium, zinc oxide, cadmium sulfide, etc., have been widely used.

On the other hand, it has been actively developed and studied in recent years to utilize various organic photoconductive materials as the material for the photosensitive layers of electrophotographic photoreceptors.

For example, Japanese patent publication No. 10496/1975 discloses an organic photoreceptor having a photosensitive layer containing poly-N-vinyl carbazole and 2,4,7-trinitro-9-fluorenone. However, this photoreceptor is not necessarily satifactory in sensitivity and durability. For improvement of such drawbacks, it has been attempted to develop an organic photosensitve member having high sensitivity and great durability by permitting different substances to be individually responsible for the carrier generation function and carrier transport function in the photosensitive layer. In such function separation type electrophotographic photoreceptor so to speak, since substances exhibiting various functions can be selected from a wide scope of materials, it is possible to prepare an electrophotographic photoreceptor having any desired characteristic with relative ease.

As the carrier generation substance effective for such a function separation type electrophotographic photoreceptor, a large number of substances have been proposed in the prior art. A typical example of using an inorganic substance is amorphous selenium as disclosed in Japanese patent publication No. 16198/1968. This is combined with an organic carrier transport substance.

Also, a large number of electrophotographic photoreceptors using organic dyes or organic pigments as the carrier generation substance have been proposed. For example, those having photosensitive layers containing bisazo compounds have been already known from Japanese provisional patent publications No. 37543/1972, No. 22834/1980, No. 79632/1979 and No. 116040/1981.

Whereas, the known photoreceptors using organic photoconductive materials are generally used for negative charging. This is because use of negative charging is advantageous in aspect of photosensitivity, etc., since mobility of the holes of the carriers is great.

However, by use of such negative charging, the following problems have been clarified to be involved. That is, the first problem is that ozone will be readily generated in the atmosphere during negative charging by a charger to worsen the environmental condition. Another problem is the positively chargeable toner which is required for developing the photoreceptor for negative charging, and the positively chargeable toner can be prepared with difficulty in view of the triboelectric charging series for ferromagnetic carrier particles.

Accordingly, it has been proposed to use a photoreceptor by use of an organic photoconductive material for positive charging. For example, in the case of a photoreceptor for positive charging in which a carrier transporting layer is laminated on a carrier generating layer and the carrier transporting layer is formed of a substance with great electron transporting ability, trinitrofluorenone, etc., is contained in the carrier transporting layer, but this substance is not suitable because of having carcinogenicity. On the other hand, it may be conceivable to give a photoreceptor for positive charging having a carrier generating layer laminated on a carrier transporting layer having a great hole transporting ability, but this becomes worsened in printing resistance, etc., due to the presence of a very thin carrier generating layer on the surface side and therefore it is not a practical layer constitution.

Also, as a photoreceptor for positive charging, U.S. Pat. No. 3,615,414 disclosed one having a thiapyrylium salt (carrier generation substance) incorporated so as to form a eutectic complex with a polycarbonate (binder resin). However, such a known photoreceptor has the drawbacks that the memory phenomenon is great and also that the ghost is liable to be generated. Also, in U.S. Pat. No. 3,357,989, a photoreceptor in which phthalocyanine is to be contained is disclosed. However, phthalocyanine is changed in characteristics depending on the crystal form and the crystal form is required to be strictly controlled. Further, it is deficient in short wavelength sensitivity and also great in the memory phenomenon, and therefore not suitable for a copying machine using a light source in the visible light wavelength region.

Under the state of the art as described above, it has been hardly realizable to use a photoreceptor by use of an organic photoconductive material for positive charging, and therefore, it has been used exclusively for negative charging.

Generally speaking, substances capable of generating carriers by absorption of visible light can hardly themselves form films except for only a part of them such as amorphous selenium, etc., and yet have the drawback of having poor retentive force for the charges given to the surface. On the contrary, substances which are excellent in film forming ability and can retain charges of 500 V or higher for a long time with a thickness of about 10 μm, have the drawback that they have generally no sufficient photoconductivity by absorption of visible light.

For such reasons, as shown in FIG. 1, it has been proposed to form a laminated product 4 by providing a carrier generating layer 2 containing a substance capable of generating charged carriers by absorption of visible light through a subbing layer 5 on an electroconductive substrate 1 such as of Aluminum, etc., and further providing a carrier transporting layer 3 for transporting either one or both of positive and negative charged carriers generated in the carrier generating layer and constitute a photosensitive layer with this laminated product. Thus, by permitting separate substances to be responsible for generation and transport of charged carriers, the selection scope of the materials can be broadened and the various characteristics demanded in electrophotographic process such as charge retentive force, surface strength, sensitivity to visible light and stability during repeated uses, etc., can be enhanced or improved.

In FIG. 1, a constitution having the carrier generating layer 2 provided on the carrier transporting layer 3 may be also alternatively used.

In such a photoreceptor, U.S. Pat. No. 4,431,722 shows to use a brominated anthanthrone pigment as a high grade organic pigment in the photosensitive layer, particularly the carrier generating layer. This pigment gives higher sensitivity as compared with the case of inorganic particles or a perylene type pigment of the prior art and can provide a photoreceptor which is uniform and has good scratch property.

However, in order to use this pigment for an electrophotographic photoreceptor, both of its crystallinity and purity are required to be enhanced and the sublimation purification method is effective for realizing this requirement. However, according to the investigations made by the present inventors, in the case of the prior art method, when the pigment obtained is pulverized and dispersed to form a coating material for photoreceptor, if the share stress applied on the pigment is great (when the substrate temperature is high, and the pigment particles are great and highly crystalline), crystal latices may be deformed or impurities are liable to be entrained from a dispersing vessel. For this reason, charging ability and sensitivity tend to be lowered, and the quantity of lowering in repeated potential to be increased. On the contrary, when the shear stress applied on the pigment is small (in this case, the substrate temperature is low, and the pigment particles are small and low crystalline), electrophotographic characteristics are unsuitably deteriorated.

SUMMARY OF THE INVENTION

An object of the present invention is to provide a photoreceptor which can exhibit high charging potential, high sensitivity and good repeating stability.

Another object of the present invention is to provide a photoreceptor, which is constituted suitably not only for negative charging but also for positive charging, particularly good in dispersibility or distribution of the carrier generation substance and capable of high charging potential and high sensitization, stabilization of residual potential and improvement of printing resistance, and can always form good visible images.

More specifically, a photoreceptor of the present invention comprises a brominated anthanthrone pigment represented by the structural formula shown below contained in the photosensitive layer.

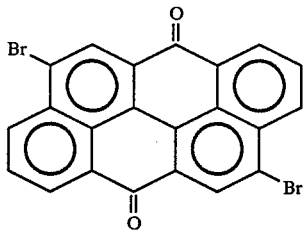

The brominated anthanthrone pigment exhibits a X-ray diffraction spectrum having the respective diffraction strengths S (18.4°) and S (26.7°) at $2\theta = 18.4°$ and 26.7° which satisfy the relationship of $$0.2 \leqq S(18.4°)/S(26.7°) \leqq 1.0.$$

From other point of view, said brominated anthanthrone pigment exhibits a X-ray diffraction spectrum having the respective half-value widths of diffraction strength of $\Delta\theta(18.4°)$ and $\Delta\theta(26.7°)$ at $2\theta = 18.4°$ and 26.7° which satisfy the relationship of $$\{\Delta\theta(18.4°) \leqq 0.8°\} \text{ and/or}$$

$$\{\Delta\theta(26.7°) \leqq 1°\}.$$

BRIEF DESCRIPTION OF THE DRAWINGS

In the accompanying drawings which are shown for illustration of the present invention.

DESCRIPTION OF THE PREFERRED EMBODIMENTS

According to the present invention, since a carrier generating layer comprising a particulate carrier generating substance, brominated anthanthrone, and a carrier transporting substance solidified with a binder resin is provided, its printing characteristic, etc., are good and at the same time the residual potential becomes stable.

The carrier generating substance should desirably have sufficient electron transporting ability in the layer. When a photosensitive layer of a mixed phase containing a carrier generating substance and a carrier transporting substance as the photoreceptor for positive charging is irradiated with light, the surface positive charges may be attenuated to some extent but tend to be no more sufficiently attenuated.

However, in the present invention, since a carrier generating substance with greater electron mobility is used, the electrons generated by photoirradiation after positive charging of the photoreceptor having the above photosensitive layer of mixed phase will be migrated at high speed to the surface, whereby the surface positive charges can be sufficiently attenuated, that is, photosensitivity is improved and residual potential also becomes smaller. On the other hand, the carrier transport substance to be used in the present invention has the property of making migration of holes easier and, due to combination with the property of the carrier generating substance as described above and presence of the carrier transporting layer of the lower layer, it is possible to realize utilization of the photoreceptor for positive charging.

Figure 2:
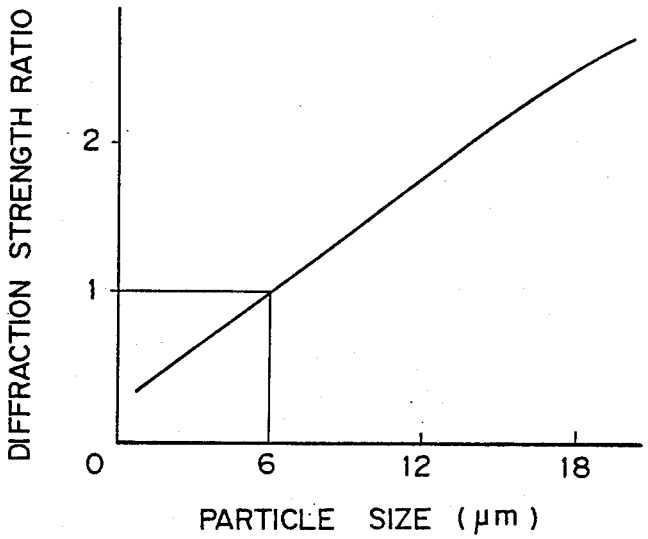
FIG. 2 is an example of the graph showing X-ray diffraction strength ratio versus particle size of the pigment.

The present inventors have found that in a pulverization procedure of the pigment, shear stress will deteriorate the characteristics by enlarging its crystal defect density, and the crystal defect density is strongly correlated with the diffraction strength ratio at diffraction angles $2\theta = 18.4°$ and 26.7° of the inherent X-ray diffraction spectrum of the above brominated anthanthrone pigment. That is the brominated anthanthrone pigment of the present invention has the diffraction strength ratio: S (18.4°)/S (26.7°) as 0.2 to 1.0. The strength ratio, as shown in FIG. 2, can be realized by controlling the particle size of the pigment after pulverization to 6 μm or less (practically 2 μm or less). Its lower limit should be 0.2, because the pigment is liable to become amorphous if the ratio is less than 0.2. It is further desirable to make the strength ratio 0.3 to 0.8.

Thus, by choosing the pulverization and dispersing time of the pigment in terms of the diffraction strength ratio, good results can be obtained as described below.

Figure 3:
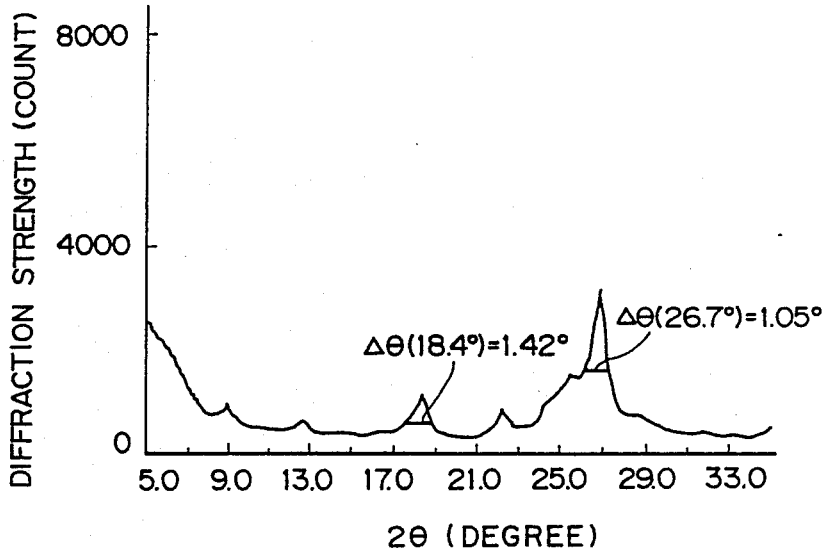
FIG. 3, FIG. 4, FIG. 5, FIG.
Figure 4:
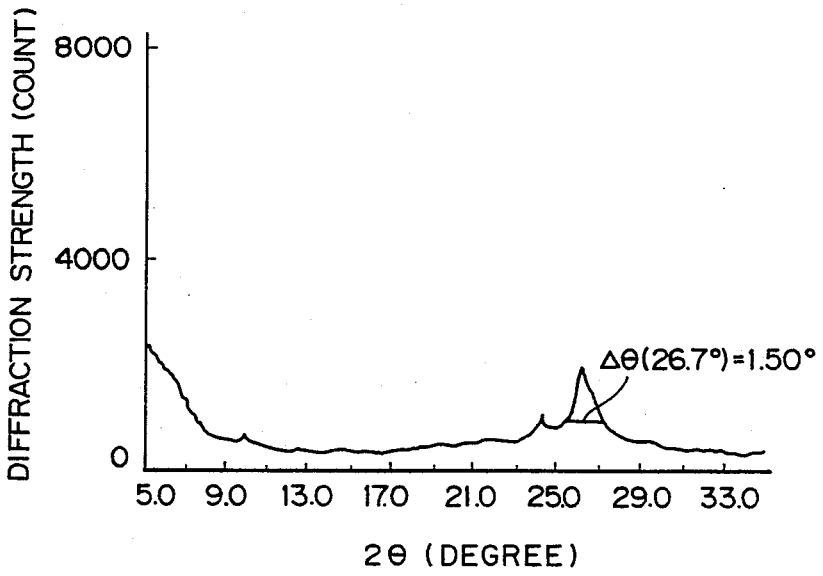

Also, the present inventors have found that the crystal defect density is intimately related to the half-value of diffraction strength (namely, the spectrum width at ½ strength of the peak of the spectrum of the diffraction strength) $\Delta\theta$ at diffraction angles $2\theta = 18.4°$ and 26.7° of the inherent X-ray diffraction spectrum of the above brominated anthanthrone pigment. The spectrum of the brominated anthanthrone pigment obtained according to the sublimation purification method of hereinbefore is shown in FIG. 3. When the pigment is pulverized in a ball mill, the peak at $2\theta = 18.4°$ becomes blunted, and $\Delta\theta(18.4°)$ and $\Delta\theta(26.7°)$ become greater as shown in FIG. 4. These $\Delta\theta$ will become further greater corresponding to the pulverization time as described later.

On the other hand, the brominated anthanthrone pigment was attempted to be prepared according to the following method.

That is, anthanthrone represented by the following formula was brominated in sulfuric acid, then poured into water, followed by separation by filtration to obtain a brominated anthanthrone having the same structural formula as used in the present invention, which was washed and dried.

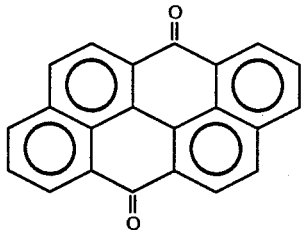

However, in this case, $\Delta\theta$ becomes so great that only amorphous non-crystalline particles can be obtained. Also, if the degree of bromination is increased, the peak at $2\theta = 18.4°$ disappears and $\Delta\theta(26.7°)$ becomes greater.

Figure 5:
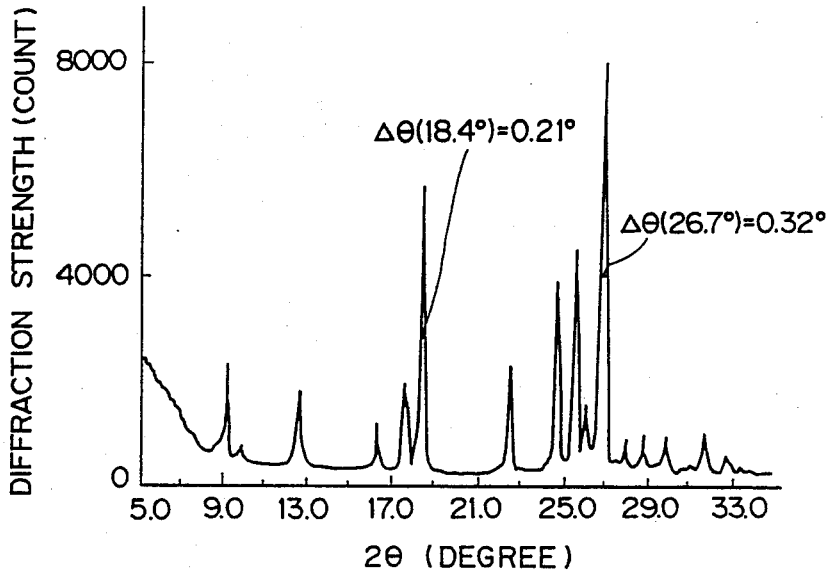
Figure 6:
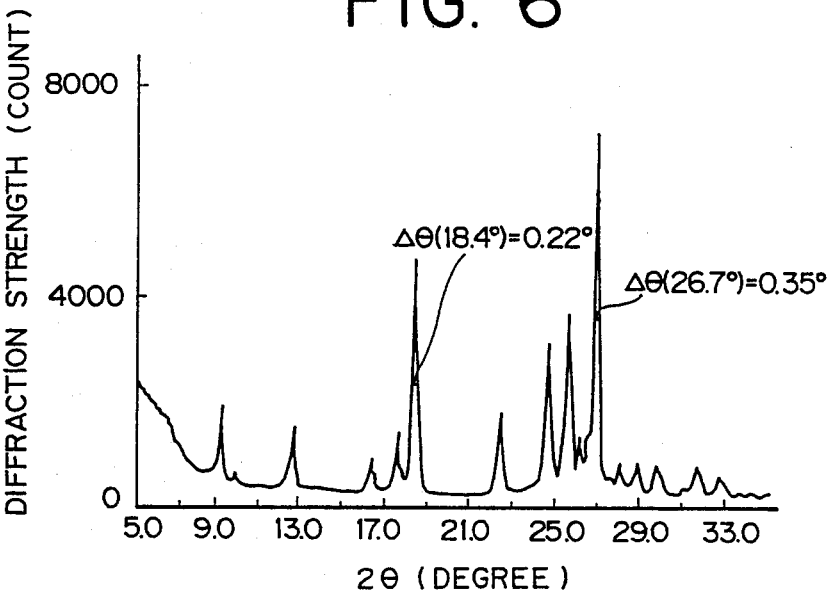
FIG. 6 and FIG. 7 each show X-ray diffraction spectrum chart of a carrier generating substance.
Figure 7:
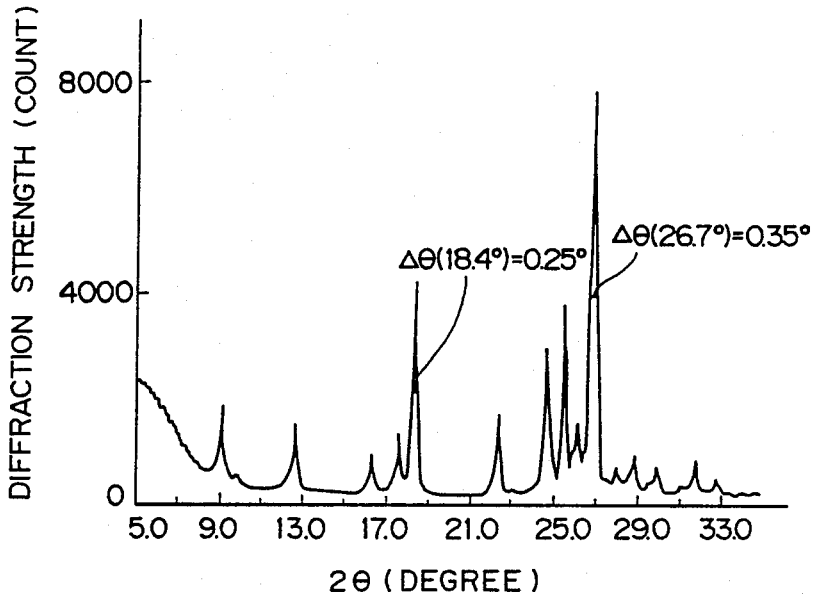

Whereas, when the crude starting material containing the sample brominated according to the above method as the main component is treated with a nonionic organic solvent selected from monochlorobenzene, nitrobenzene, β-naphthol, 1-chloronaphthalene, etc. (desirably a borderline solvent comprising this organic solvent and an ionic solvent comprising an acid such as $H_2SO_4$, etc., or an alkali such as NaOH, etc.) to be crystallized and aged, and thereafter washed and separated by filtration, a high crystalline brominated anthanthrone pigment was found to be obtained. FIG. 5 shows the spectrum when using a mixed solvent of the above nonionic organic solvent and an acid, FIG. 6 that when using a mixed solvent of the above nonionic organic solvent and an alkali and FIG. 7 that when using the above nonionic organic solvent. It can be seen that the half-value width $\Delta\theta$ is small and the peak is great, namely crystallinity and purity are good in any case (particularly examples in FIG. 5 and FIG. 6 are good).

Also, according to such a chemical purification method so to speak, it has been found that a crystalline clean purified product can be obtained from an amorphous starting material. Further, according to the chemical purification method, the pigment will not be decomposed and the desired product can be obtained with good yield without corrosion by debromination.

The pigment according to the present invention is not limited to those obtained by the above chemical purification method but can be produced according to another method. For example, according to the sublimation purification method, it is possible to obtain a pigment with a half-value width $\Delta\theta(18.4°)$ of 0.8° or less and $\Delta\theta(26.7°)$ of 1° or less.

The brominated anthanthrone pigment according to the chemical purification method, etc., as described above is practically pulverized and dispersed to a desired particle size. During pulverization, it has been found that $\Delta\theta$ is changed depending on the pulverization time, particularly that the pulverization time can be selected so as to give $$\{\Delta\theta(18.4°) \leqq 0.8°\} \text{ and/or}$$

$$\{\Delta\theta(26.7°) \leqq 1°56 .$$

With such half-value width ranges, as apparently seen from the data described below, the crystal defect density of the pigment particles is lowered to improve greatly the electrophotographic characteristics.

Also, with respect to the particle shape of the brominated anthanthrone pigment, if the short axis length is defined as a and the long axis length as b, it is desirable to make $b/a \geqq 1.1$. That is, excellent characteristics were found to be obtained with such a ratio. Since the strength (absolute value) is lowered in spite of improvement of $\Delta\theta$ with micropulverization, it may sometimes occur that no sufficient crystallinity can be obtained even though $\Delta\theta \leqq 1°$ may be satisfied. In other words, even if $\Delta\theta \leqq 1°$, because crystallinity of particles is liable to be lowered at $b/a < 1.1$, it is preferable to make $b/a \geqq 1.1$, further $1.1 \leqq b/a \leqq 20$. More preferably, the ratio should be made $1.5 \leqq b/a \leqq 15$.

Here, the long axis length b shows the length of the axis having the longest distance (long axis) in the crystal selected arbitrarily in an electron microscope photograph. On the other hand, the short axis length a shows the length of the axis which passes the middle point of the above long axis and has the shortest distance (short axis).

In electron microscope photograph, as the method for selecting arbitrarily crystals, for example, in the present invention, each 5 lines at intervals of 1 cm were drawn longitudinally and laterally on the photograph, and the crystals on the crossed points were selected. The long axis length b and short axis length a of these crystals were measured and b/a was calculated for each of the crystals.

The b/a as herein mentioned shows the average value of b/a of the above respective crystals.

And, the mean particles size (which means here the average value of the above long axis length b) of the brominated anthanthrone pigment particles should desirably be made 2 μm or less. This is because the influence of the particle size on the surface of the photoreceptor can be prevented by comminution to 2 μm or less to make the surface of photoreceptor smooth and also the pigment dispersion can be stabilized. If the mean particle size exceeds 2 μm, convexities are liable to be formed on the surface, while with a mean particle size of 2 μm or less a flat surface can be realized by eliminating substantially such convexities, and also the dispersion can be stabilized by decreased sedimentation of the particles therein. As a result, it becomes possible to obtain a photoreceptor which is free from discharing destruction or toner filming. The mean particle size of the pigment may be desirably 2 μm or less, more desirably 1 μm or less, further desirably 0.5 μm or less. However, if the mean particle size is too small, the crystal defects may be contrariwise increased to lower repeating characteristic and also the degree of comminution is limited, and therefore the lower limit of the mean particle size should desirably be 0.01 μm.

Also, in the present invention, in the above carrier generating layer existing on the surface side, by incorporating a carrier generating substance relative to a binder resin within a specific range of carrier generating substance/binder resin=10 to 300 parts by weight/100 parts by weight (desirably 30 to 200 parts by weight/100 parts by weight), a photoreceptor for positive charging with little residual potential and lowering in receptor potential can be provided. If the carrier generating substance is smaller outside of the above range, photosensitivity becomes poor to increase residual potential, while more amount of the carrier generating substance tends to increase lowering in receptor potential. Also, the content of the carrier transport substance is important and, by making the carrier transporting substance/binder resin=20 to 200 parts by weight/100 parts by weight (desirably 30 to 100 parts by weight/100 parts by weight), the residual potential is small and also photosensitivity becomes good within this range, whereby the solvent solubility of the carrier transporting substance can be also maintained good. If the carrier transport substance is smaller outside of this range, the residual potential or photosensitivity is liable to be deteriorated, while solvent solubility will be worsened if it is too much. The content range of the carrier transporting substance may be also the same in the carrier transporting layer.

Also, the ratio of the above carrier generating substance to the above carrier transporting substance in the carrier generating layer, in order to exhibit effectively the respective functions of both substances, the carrier generating substance: the carrier transporting substance should desirably be (1:0.2) to (1:3) in terms of weight ratio, more preferably (1:0.4) to (1:2.0). In the present invention, the film thickness of the carrier generating layer should desirably be 0.6 to 10 μm.

More specifically, when the film thickness of the charge generating layer is less than 0.6 μm, sensitivity may be lowered or the surface of the charge generating surface may receive mechanical damages depending on the mode of use such as developing and cleaning, whereby there are tendencies such that a part of the layer may be scraped off and that black streaks may appear on the image. However, when the film thickness of the charge generating layer is so large as exceeding 10 μm, the number of the heat-excited carriers generated is increased to lower the receptor potential with increase in the environmental temperature, whereby the density on the image tends to be lowered. Further, when a light with longer wavelength than the absorption end of the carrier generating substance is irradiated, photocarriers are generated even near the lowest portion in the charge generation layer. In this case, the electrons must be migrated through the layer to the surface and therefore there is the tendency that no sufficient transporting ability can be generally obtained. Accordingly, sensitivity may be lowered or elevation of the residual potential is liable to occur during repeated uses.

For the above reasons, the film thickness of the charge generating layer should desirably be 0.6 μm and 10 μm or less. Further, the preferable range is 1.0 to 8.0 μm, but in this case the above ratio (carrier generating substance:carrier transporting substance) should desirably be (1:0.4) to (1:2.0).

On the other hand, the film thickness of the above charge transporting layer should preferably be 5 μm or more and 50 μm or less, more preferably 5 μm or more and 30 μm or less.

Further, the film thickness ratio of the carrier generating layer to carrier transporting layer should desirably be 1:(1 to 30) .

In the present invention, when forming a carrier generating layer with a structure having the carrier generating substance dispersed in particulate form (as the pigment) in the layer having a carrier transporting substance solidified with the binder material, it is desirable to make the mean particle size of the carrier generating substance 2 μm or less, particularly 1 μm or less. If the mean particle size is too great, dispersibility will be lowered, whereby the particles are localized as a mass and excessive toner will be attached on this portion to thereby cause readily the so-called toner filming.

In the present invention, by addition of an electron accepting substance or Lewis acid as described below in the photosensitive layer, a charge transfer complex can be formed to further improve the sensitizing effect.

The carrier tranporting substance to be used in the present invention may include oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline derivatives, oxazolone derivatives, benzothiazole derivatives, benzimidazole derivatives, quinazoline derivatives, benzofuran derivatives, acridine derivatives, phenazine derivatives, aminostilbene derivatives, poly-N-vinylcarbazole, poly-1-vinylpyrene, poly-9-vinylanthracene, etc.

As the carrier transporting substance, styryl compounds represented by the following formula [I] or [II] can be used.

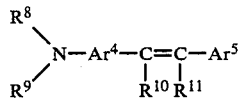

[I]

(wherein $R^8$ and $R^9$ each represent a substituted or unsubstituted alkyl group or an aryl group, and the substituent may be an alkyl group, an alkoxy group, a substituted amino group, a hydroxyl group, a halogen atom or an aryl group; $Ar^4$ and $Ar^5$ each represent a substituted or unsubstituted aryl group, and the substituent may be an alkyl group, an alkoxy group, a substituted amino group, a hydroxyl group, a halogen atom or an aryl group; $R^{10}$ and $R^{11}$ each represent a substituted or unsubstituted aryl group or a hydrogen atom, and the substituent may be an alkyl group, an alkoxy group, a substituted amino group, a hydroxy group, a halogen atom or an aryl group).

[II]

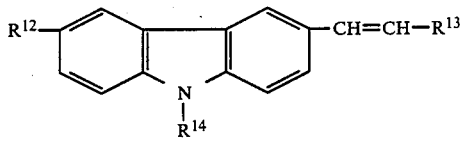

(wherein $R^{13}$ represents a substituted or unsubstituted aryl group; $R^{12}$ represents a hydrogen atom, a halogen atom, a substituted or unsubstituted alkyl group, an alkoxy group, an amino group or a substituted amino group; $R^{14}$ represents a substituted or unsubstituted aryl group, or a substituted or unsubstituted heterocyclic group).

Specific examples of the styryl compounds of these formula [I] or [II] are shown below.

(I-1)

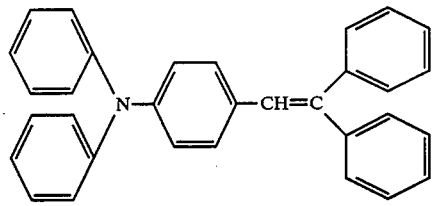

(I-2)

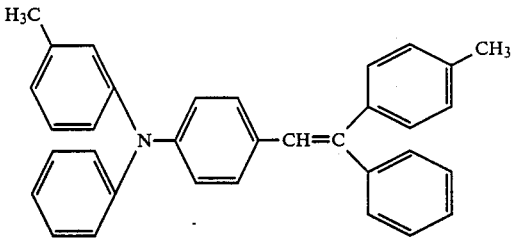

(I-3)

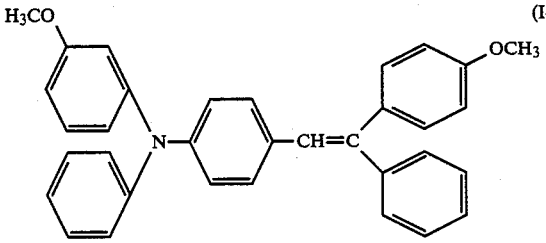

(I-4)

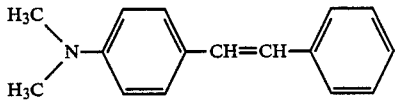

(I-5)

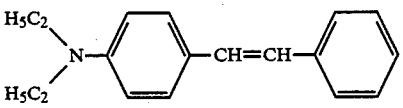

(I-6)

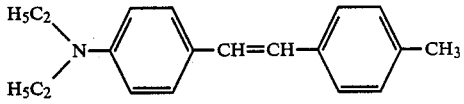

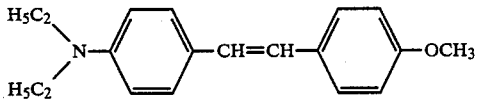

(I-7)

(I-8)

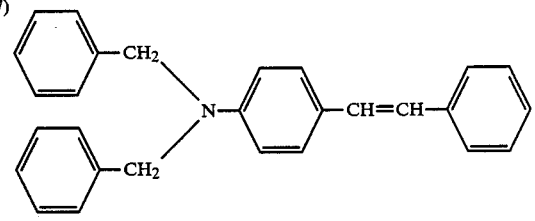

(I-9)

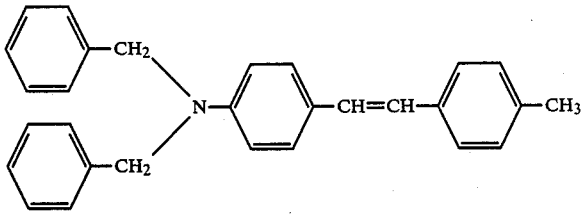

(I-10)

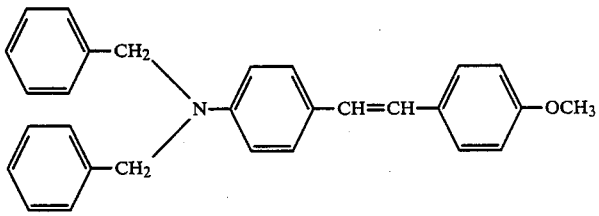

-continued
(I-11)
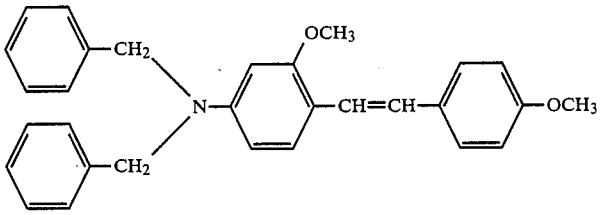
(I-12)
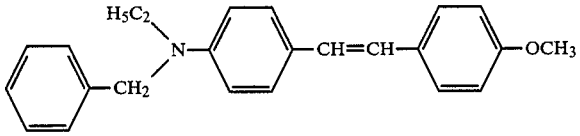
(I-13)
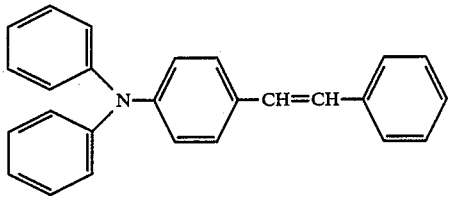
(I-14)
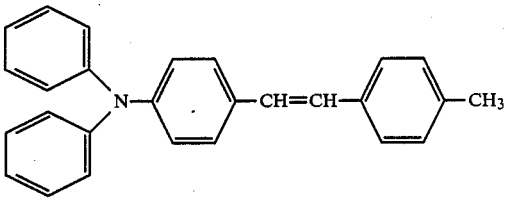
(I-15)
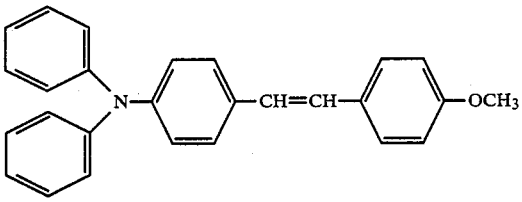
(I-16)
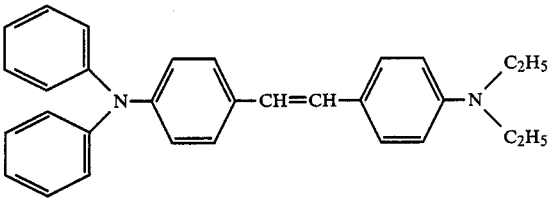
(I-17)
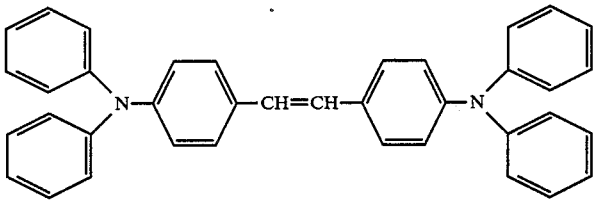
(I-18)
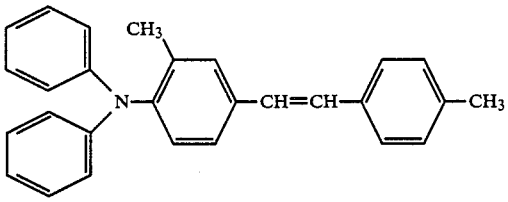
(I-19)
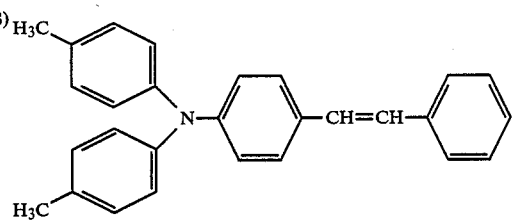
(I-20)
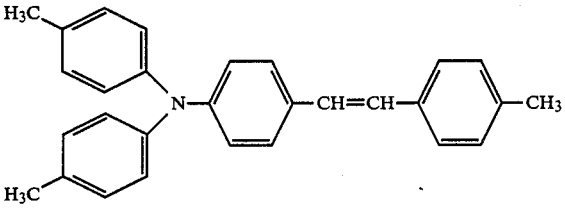

-continued
(I-21)
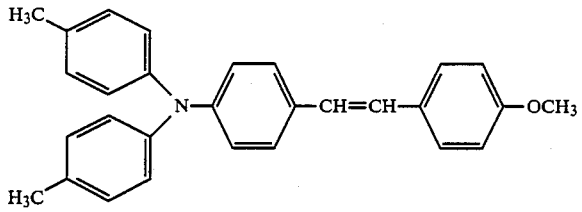
(I-22)
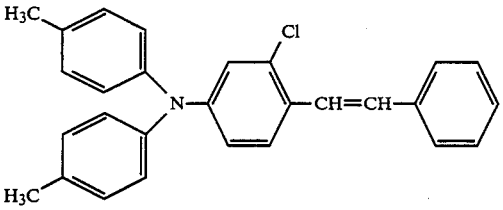
(I-23)
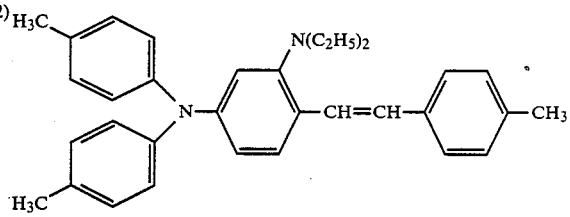
(I-24)
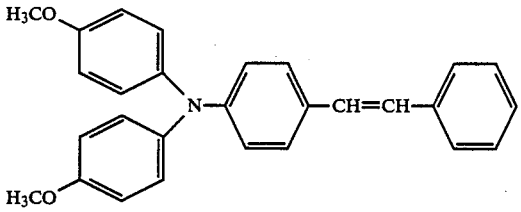
(I-25)
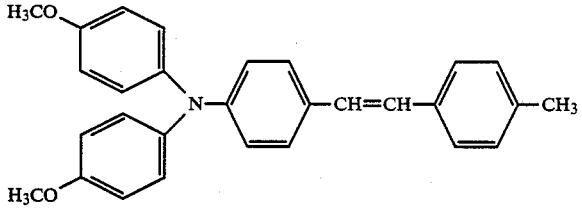
(I-26)
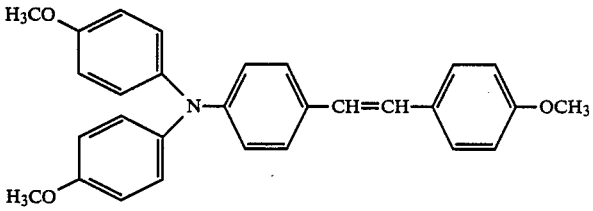
(I-27)
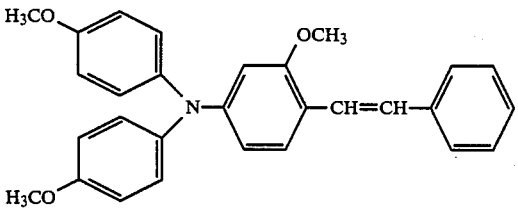
(I-28)
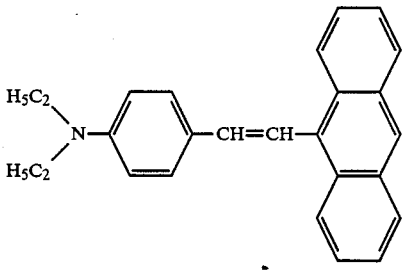
(I-29)
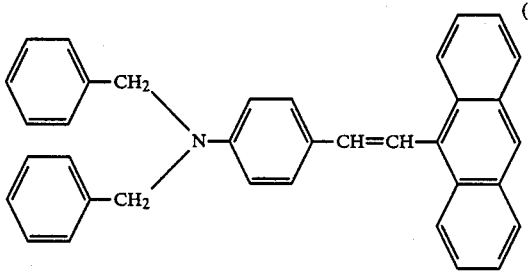
(I-30)
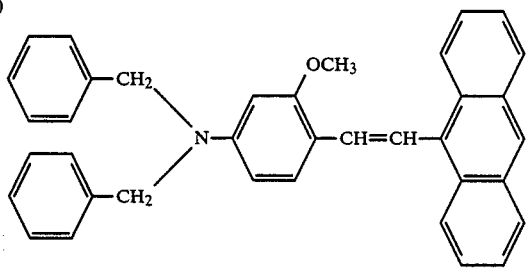

-continued
(I-31)
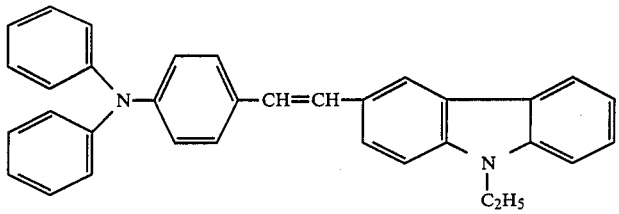
(I-32)
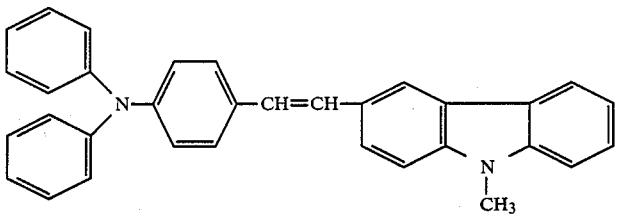
(I-33)
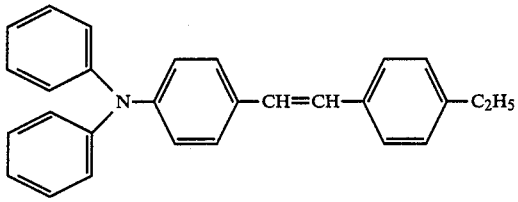
(I-34)
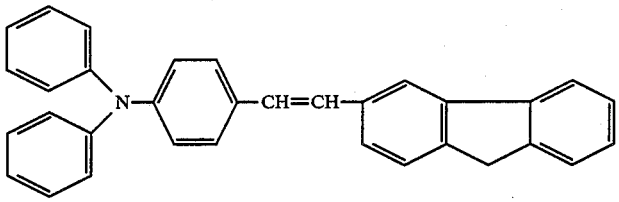
(I-35)
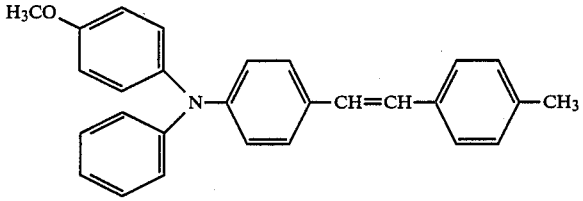
(I-36)
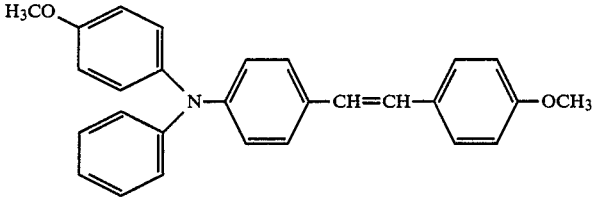
(I-37)
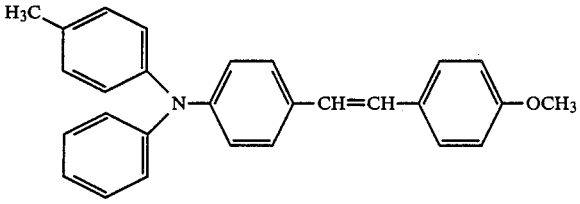

-continued
(I-38)
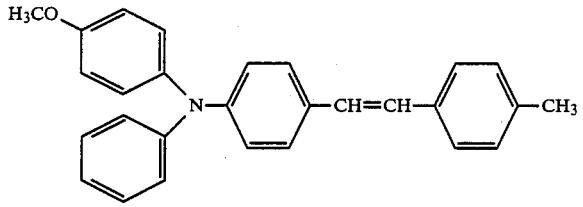
(I-39)
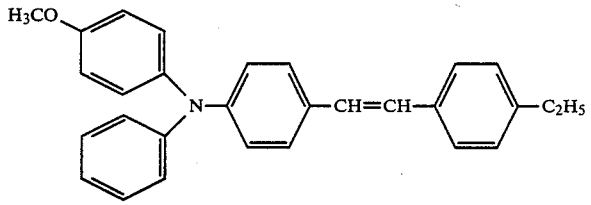
(I-40)
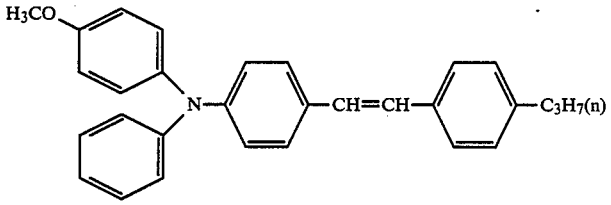
(I-41)
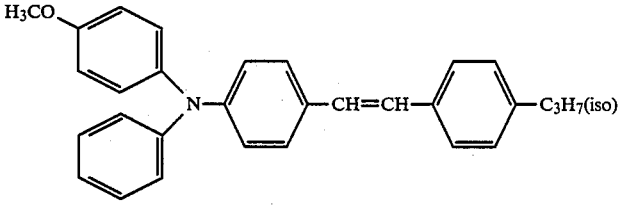
(I-42)
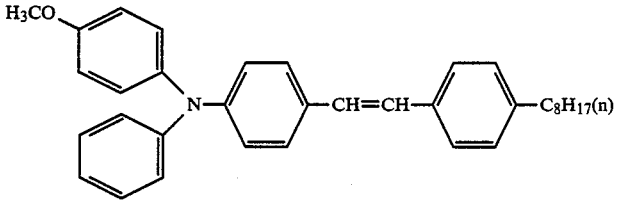
(I-43)
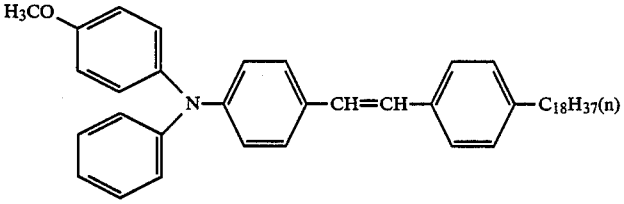
(I-44)
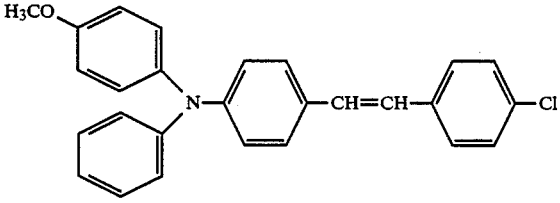

-continued
(I-45)
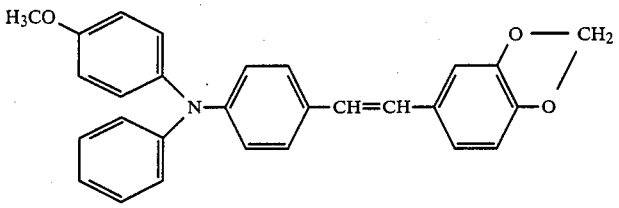
(I-46)
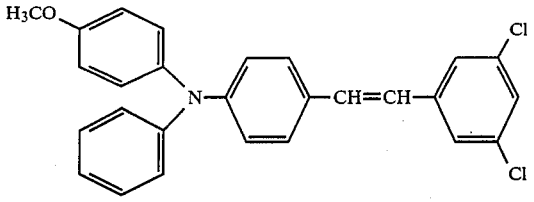
(I-47)
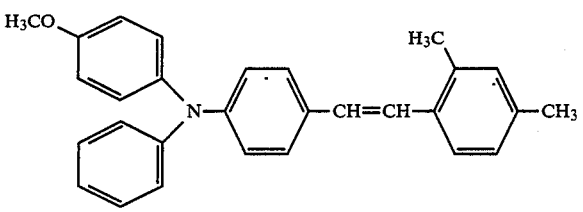
(I-48)
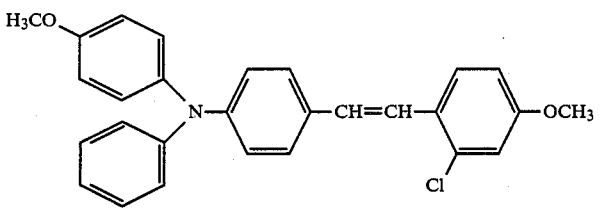
(I-49)
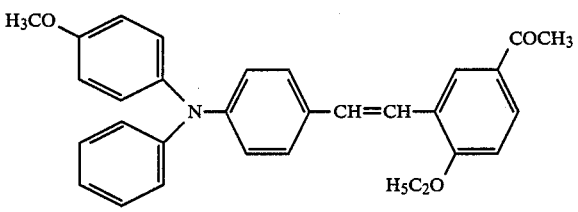
(I-50)
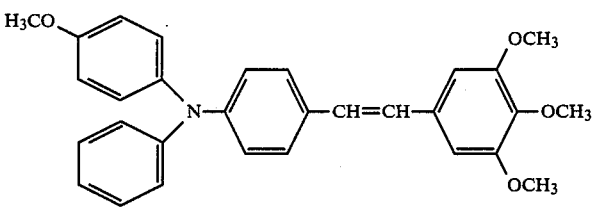
(I-51)
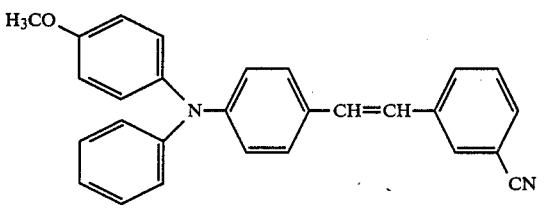

-continued
(I-52)
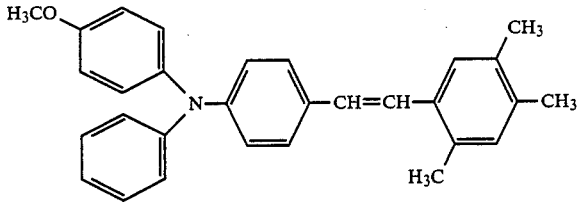
(I-53)
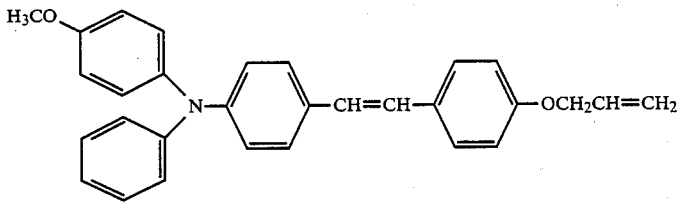
(I-54)
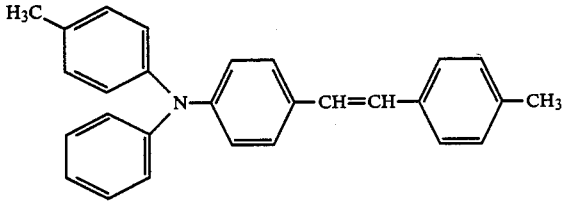
(I-55)
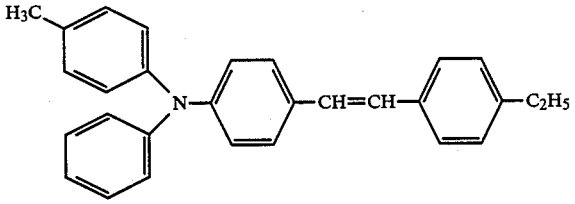
(I-56)
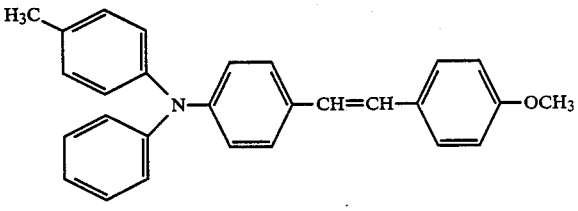
(I-57)
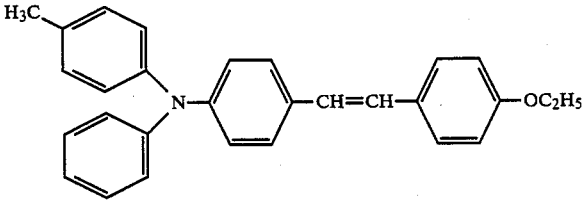
(I-58)
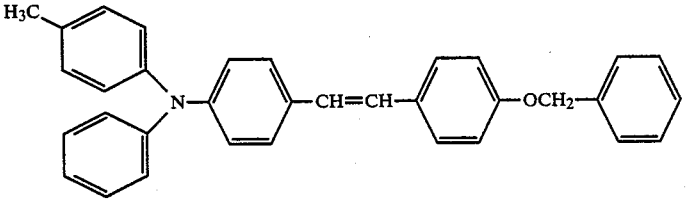

-continued
(I-59)
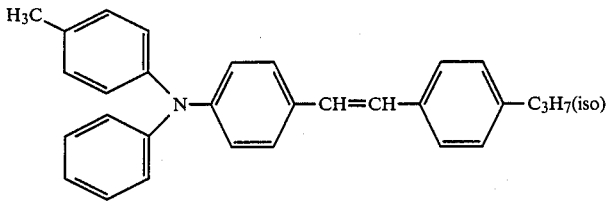
(I-60)
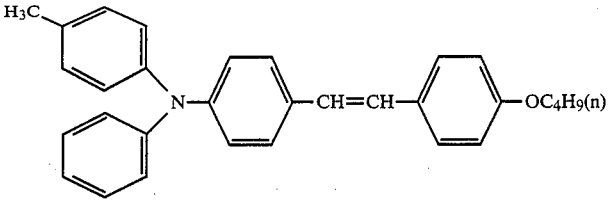
(I-61)
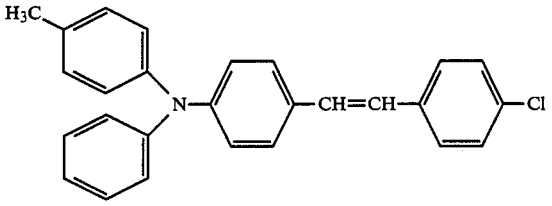
(I-62)
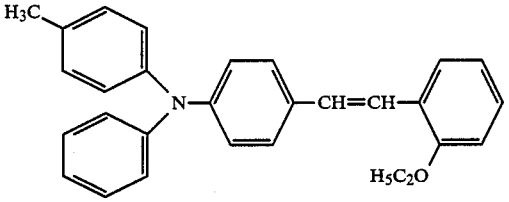
(I-63)
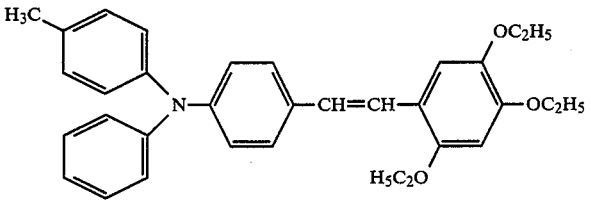
(I-64)
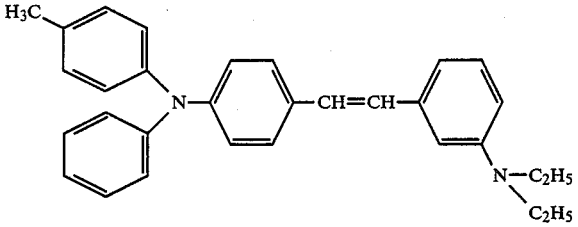
(I-65)
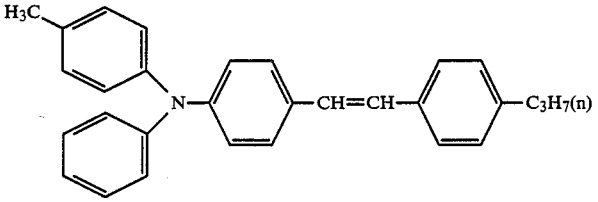

-continued
(I-66)
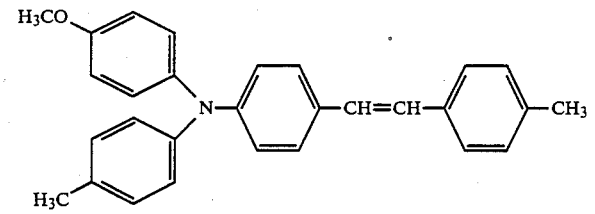
(I-67)
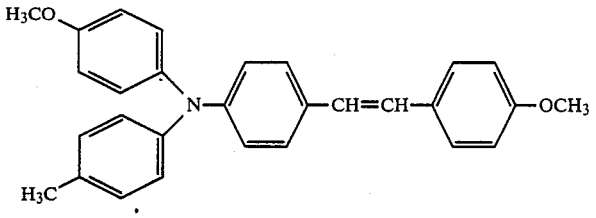
(I-68)
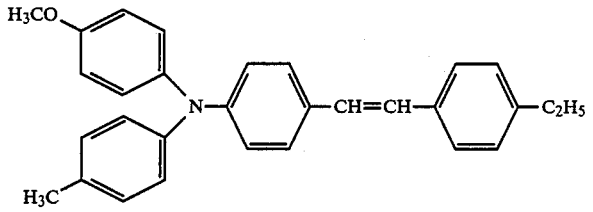
(I-69)
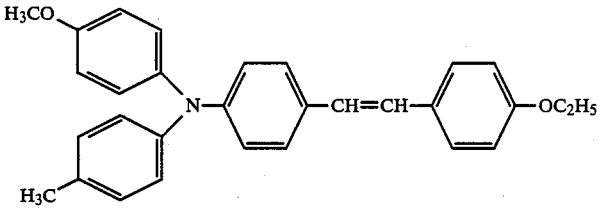
(I-70)
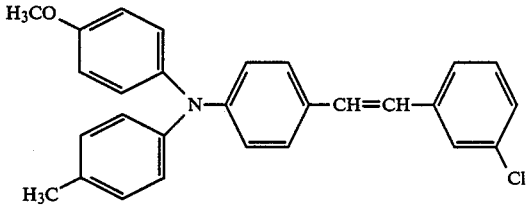
(I-71)
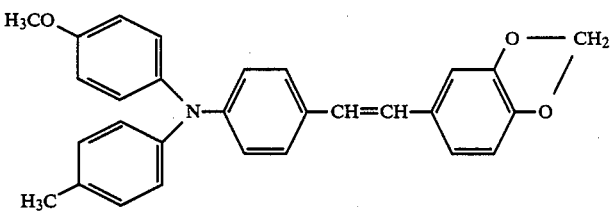
(I-72)
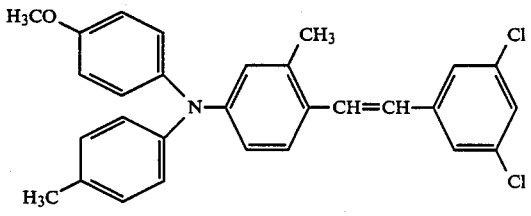

-continued
(I-73)
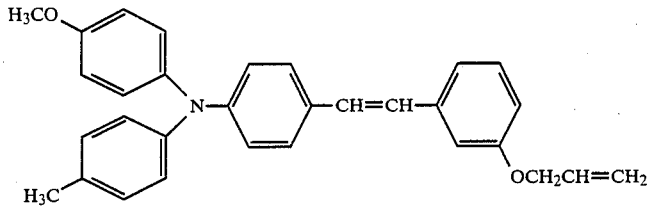
(I-74)
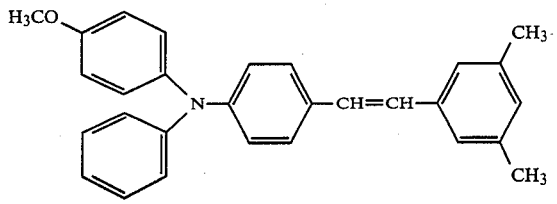
(I-75)
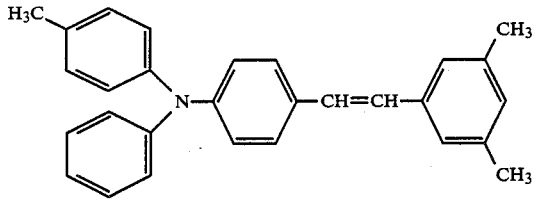
(I-76)
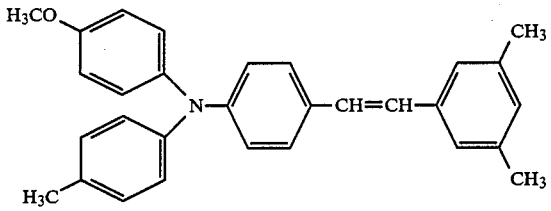
(I-77)
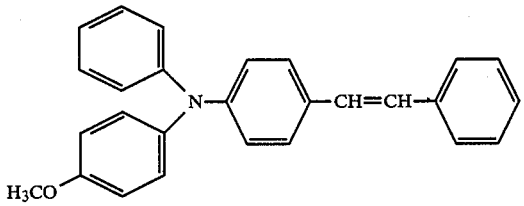
(I-78)
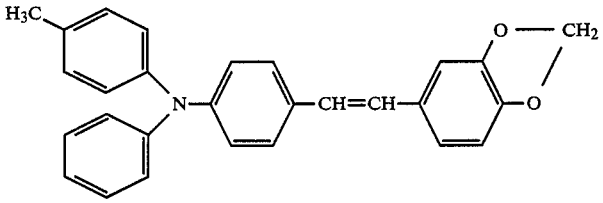
(II-1)
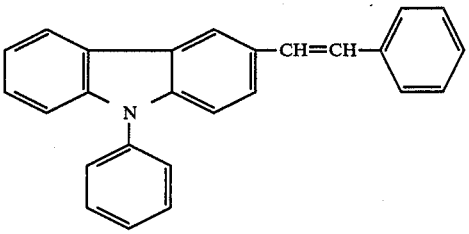

-continued
(II-2)
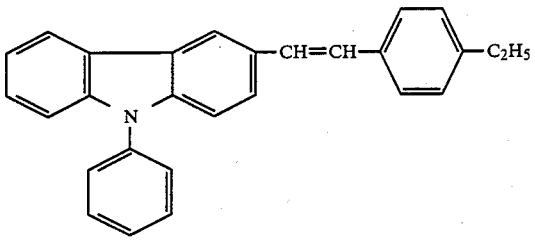
(II-3)
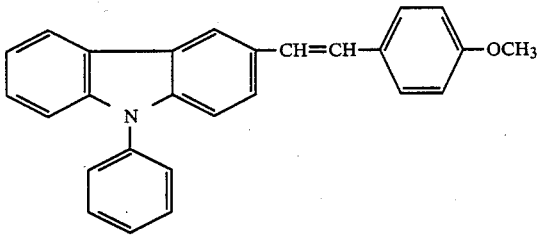
(II-4)
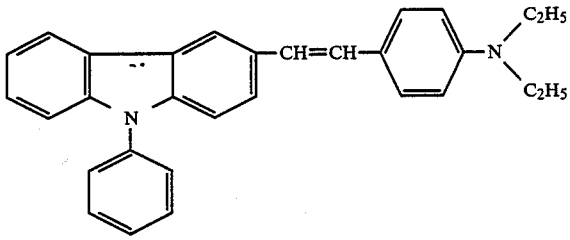
(II-5)
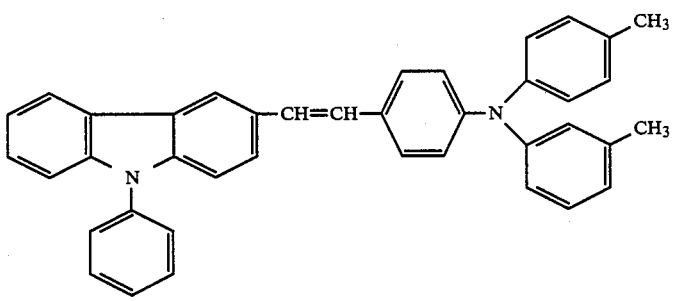
(II-6)
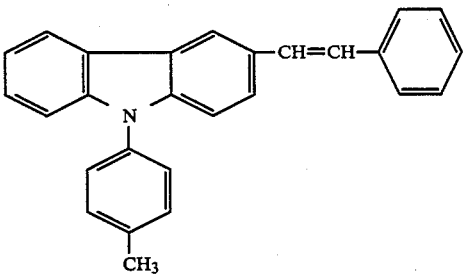
(II-7)
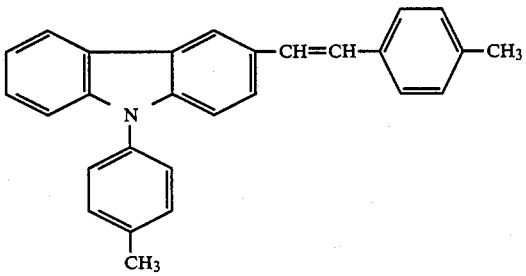

-continued
(II-8)
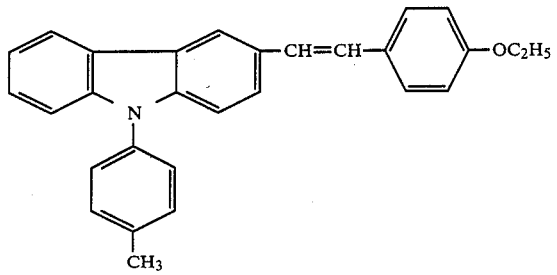
(II-9)
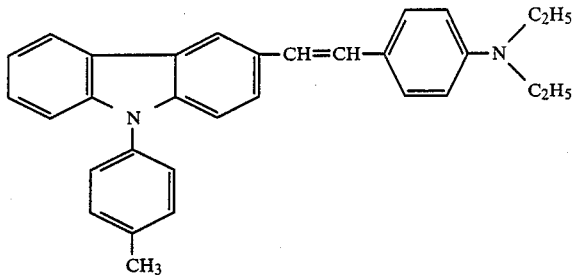
(II-10)
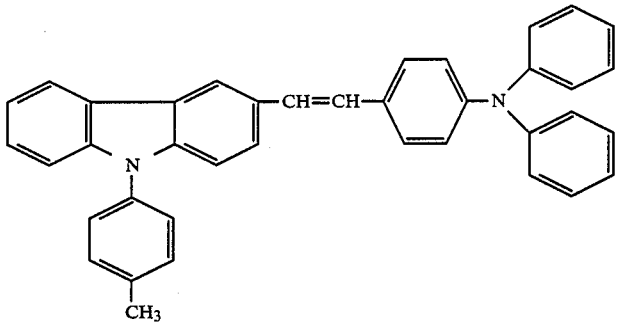
(II-11)
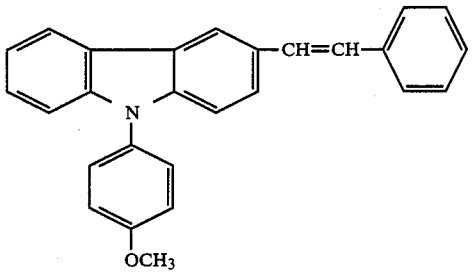
(II-12)
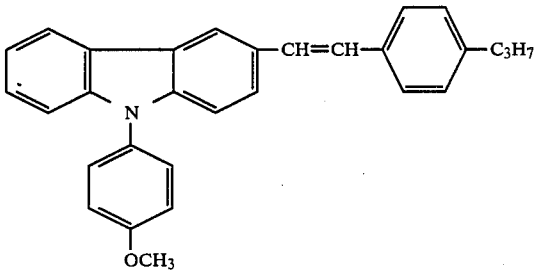

-continued
(II-13)
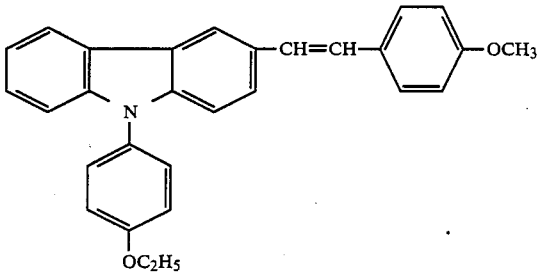
(II-14)
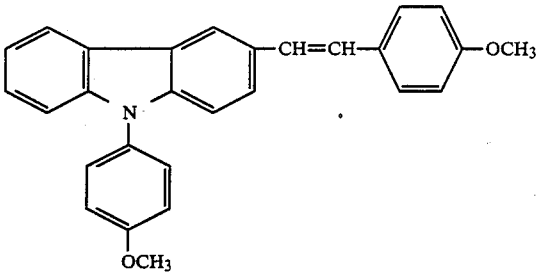
(II-15)
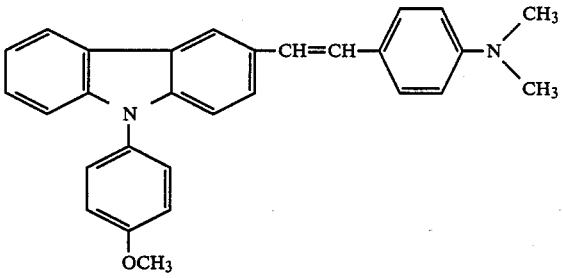
(II-16)
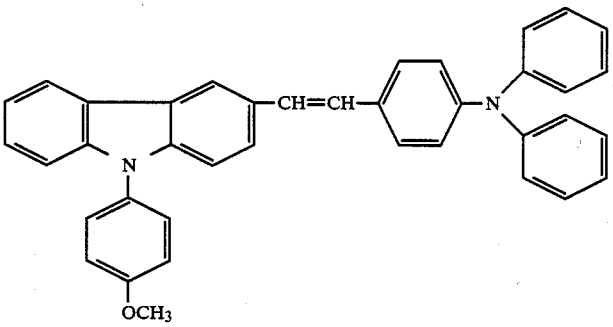
(II-17)
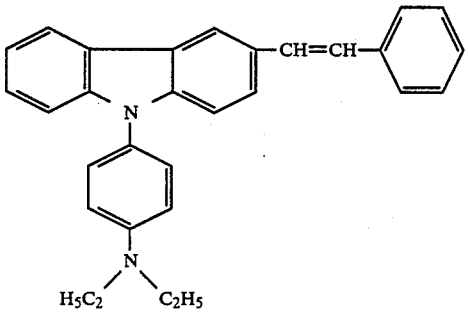

-continued
(II-18)
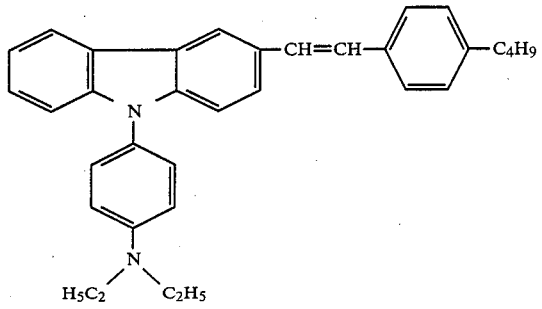
(II-19)
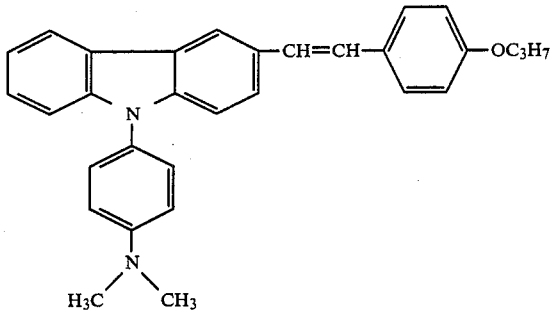
(II-20)
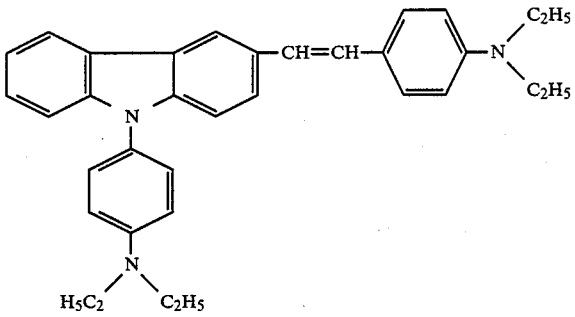
(II-21)
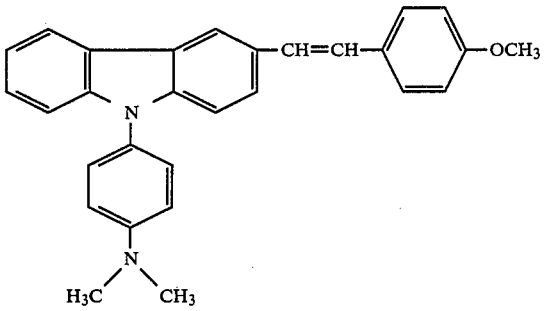
(II-22)
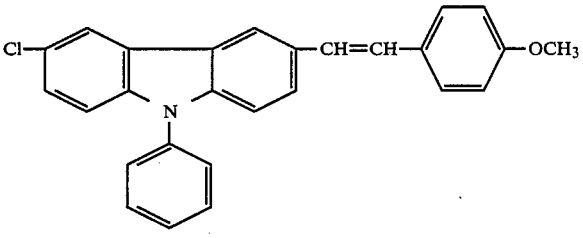

-continued
(II-23)
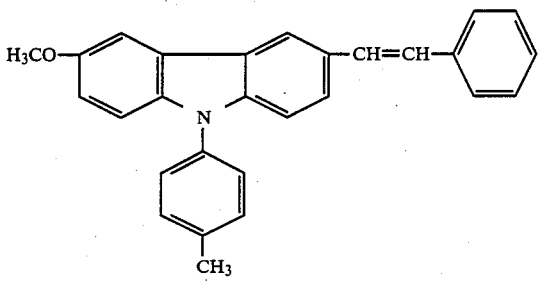
(II-24)
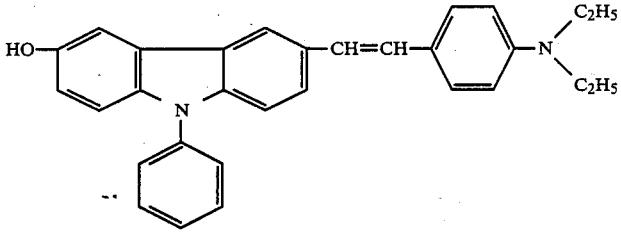
(II-25)
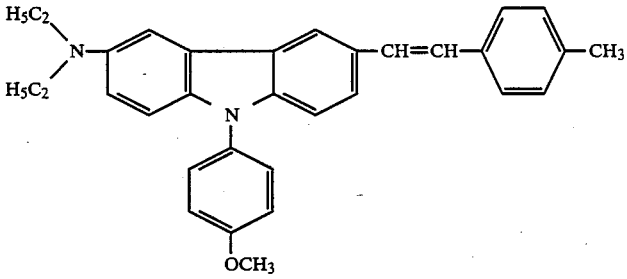
(II-26)
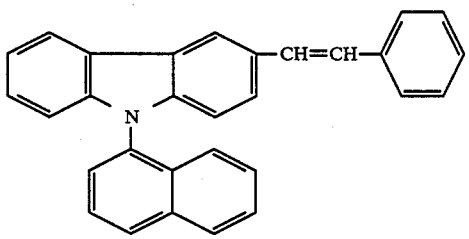
(II-27)
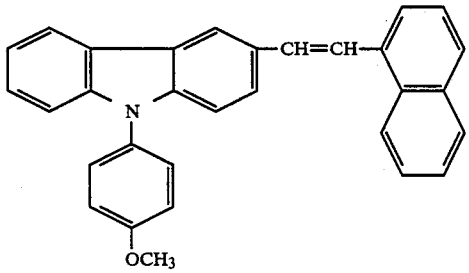

-continued
(II-28)
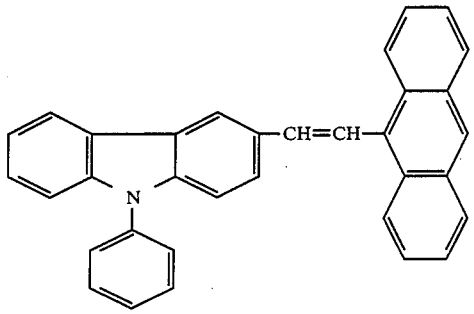
(II-29)
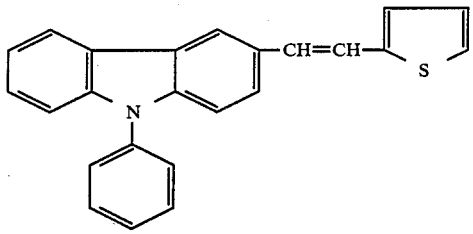
(II-30)
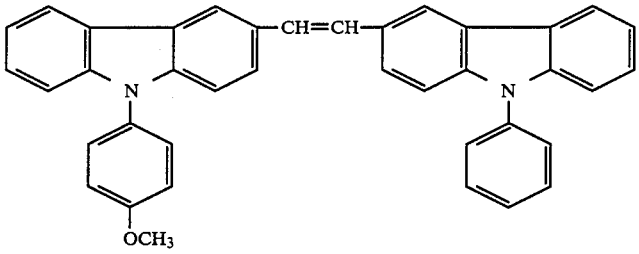
(II-31)
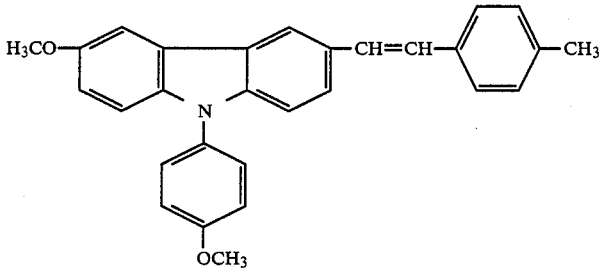
(II-32)
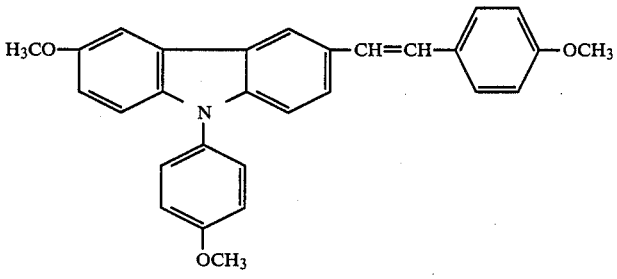

-continued (II-32)

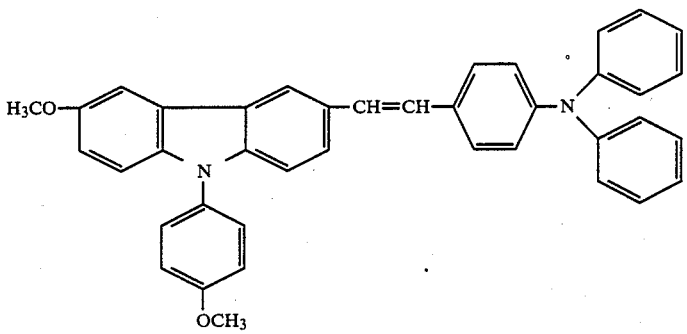

Also, as the carrier transporting substance, hydrazone compounds represented by the following formula [III], [IV], [V] or [VI] may be used.

[III]

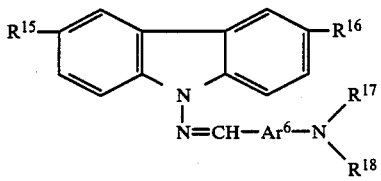

(wherein $R^{15}$ and $R^{16}$ each represent a hydrogen atom or a halogen atom; $R^{17}$ and $R^{18}$ each represent a substituted or unsubstituted aryl group; and $Ar^6$ represents a substituted or unsubstituted arylene group.)

[IV]

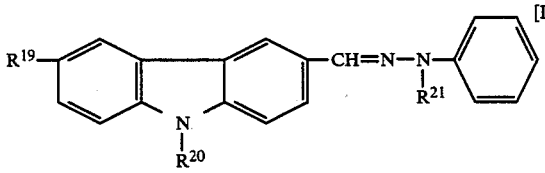

(wherein $R^{19}$ represents a hydrogen atom, a halogen atom, a methyl group, an ethyl group, a 2-hydroxyethyl group or a 2-chloroethyl group; $R^{20}$ represents a methyl group, an ethyl group, a benzyl group or a substituted or unsubstituted phenyl group; and $R^{21}$ represents a methyl group, an ethyl group, a benzyl group, a substituted or unsubstituted phenyl group or naphthyl group.)

[V]

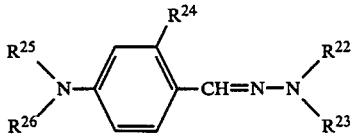

(wherein $R^{22}$ represents a substituted or unsubstituted phenyl group or a naphthyl group; $R^{23}$ represents a substituted or unsubstituted alkyl group, aralkyl group or aryl group; $R^{24}$ represents a hydrogen atom, an alkyl group or an alkoxy group; $R^{25}$ and $R^{26}$ may be the same or different and each represent a substituted or unsubstituted alkyl group, aralkyl group or aryl group.)

[VI]

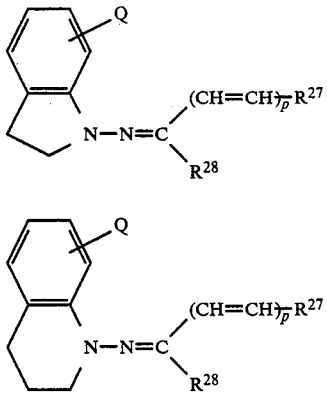

(wherein $R^{27}$ represents a substituted or unsubstituted aryl group or a substituted or unsubstituted heterocyclic group; $R^{28}$ represents a hydrogen atom, a substituted or unsubstituted alkyl group or a substituted or unsubstituted aryl group; Q represents a hydrogen atom, a halogen atom, an alkyl group, a substituted amino group, an alkoxy group or a cyano group; and represents an integer of 0 or 1.)

Specific examples of these hydrazon compounds of the formulae [III] to [VI] are shown below.

(III-1)

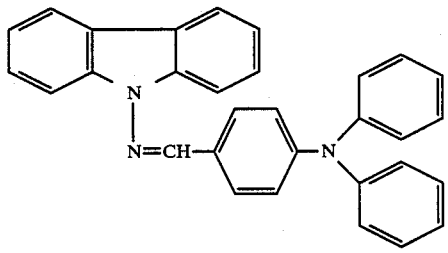

(III-2)

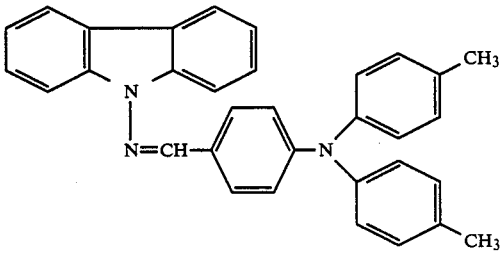

-continued
(III-3)
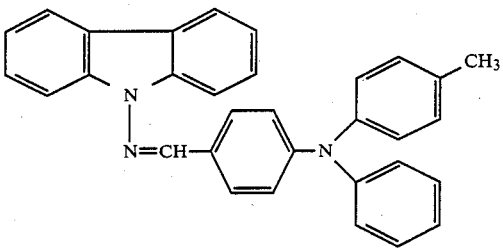
(III-4)
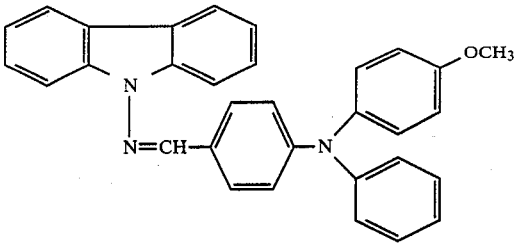
(III-5)
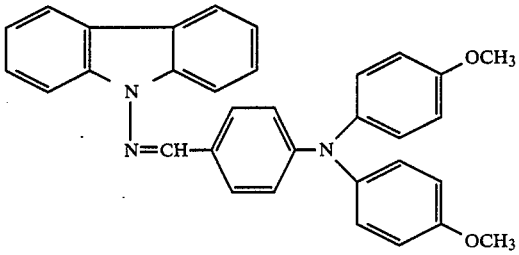
(III-6)
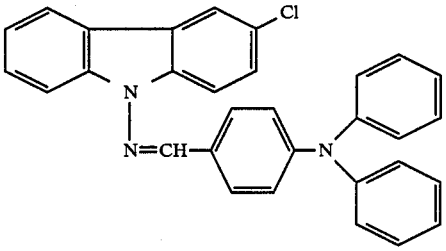
(III-7)
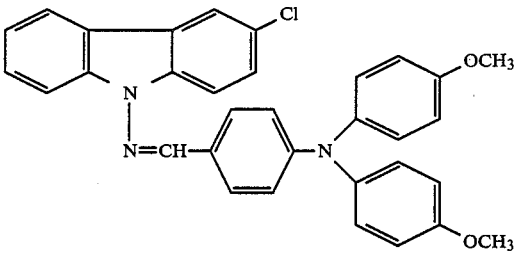
(III-8)
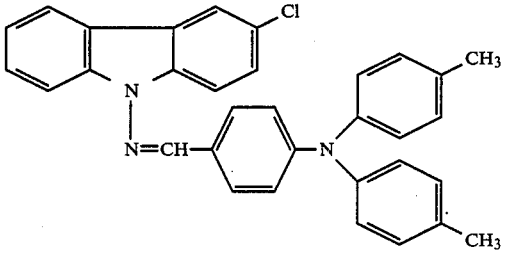
-continued
(III-9)
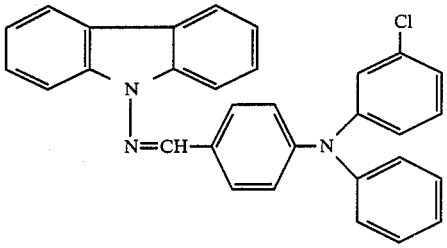
(III-10)
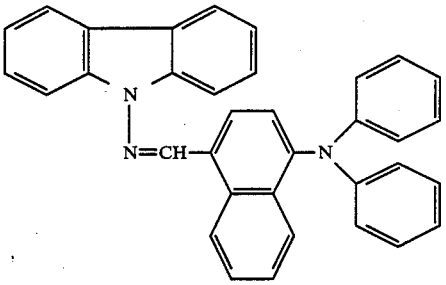
(III-11)
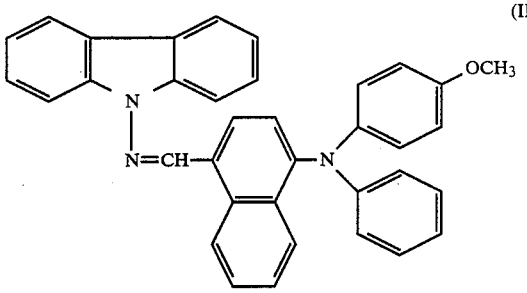
(III-12)
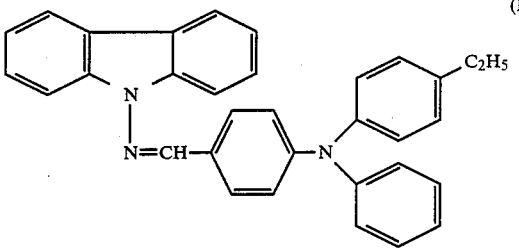
(III-13)
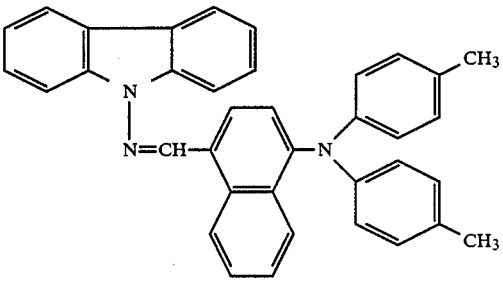

-continued
(III-14)
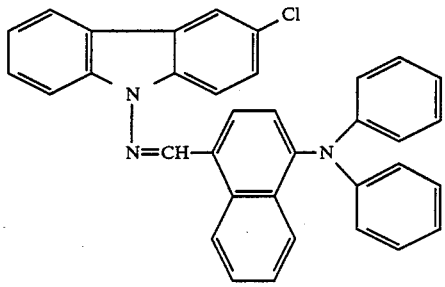
(IV-1)
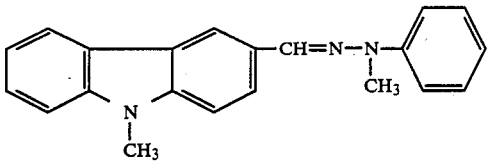
(IV-2)
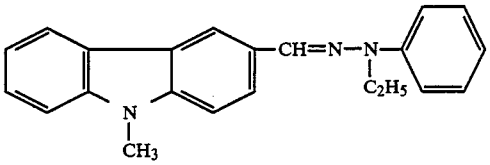
(IV-3)
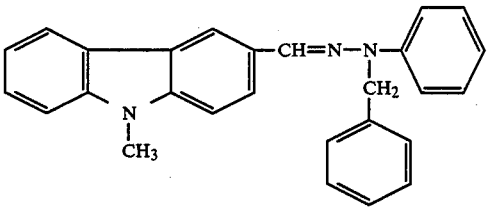
(IV-4)
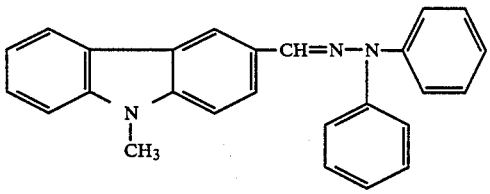
(IV-5)
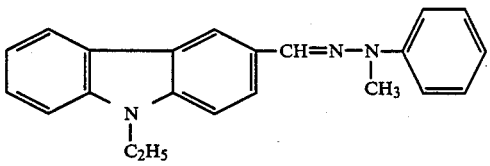
(IV-6)
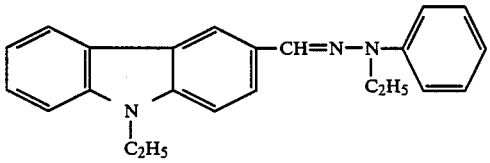
-continued
(IV-7)
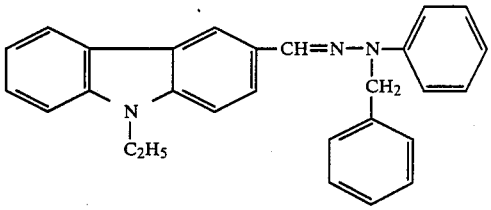
(IV-8)
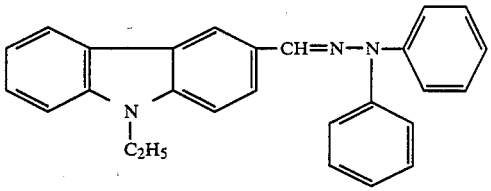
(IV-9)
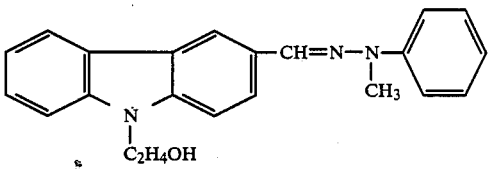
(IV-10)
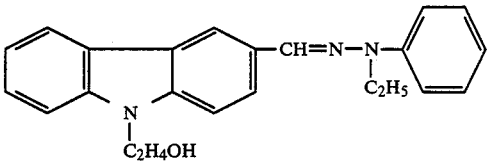
(IV-11)
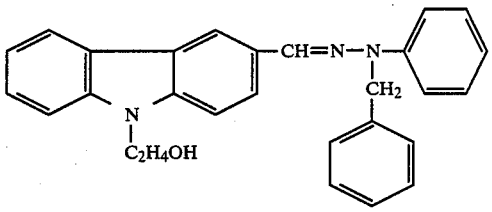
(V-1)
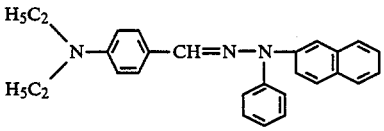
(V-2)
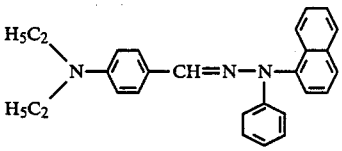
(V-3)
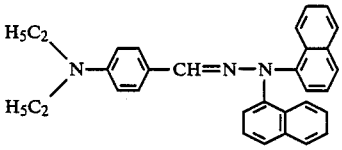

-continued
(V-4)
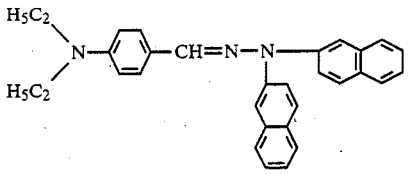
(V-5)
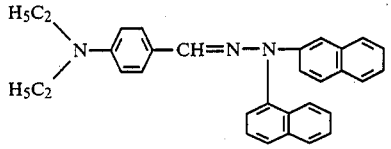
(V-6)
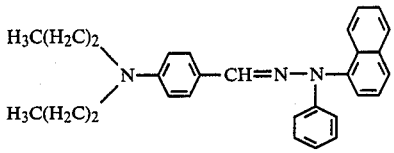
(V-7)
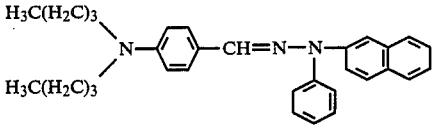
(V-8)
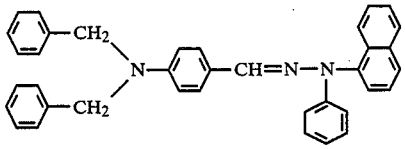
(V-9)
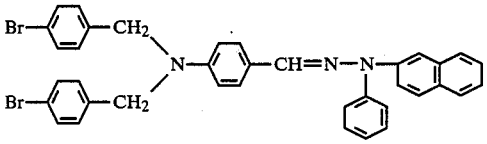
(V-10)
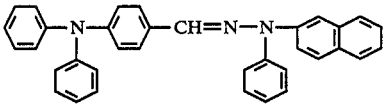
(V-11)
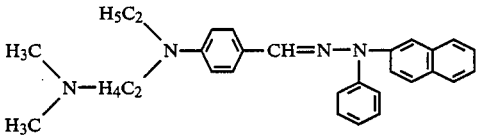
(V-12)
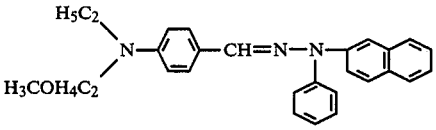
(V-13)
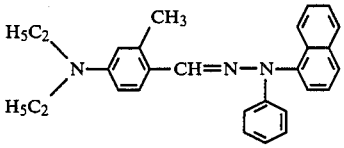
-continued
(V-14)
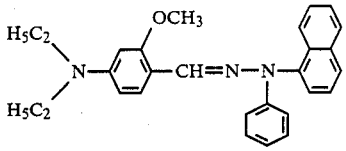
(V-15)
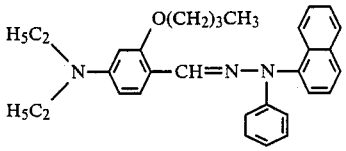
(V-16)
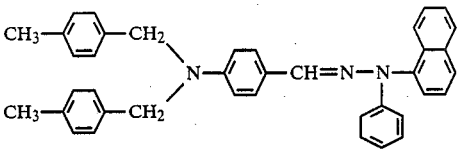
(V-17)
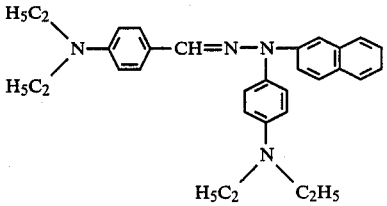
(V-18)
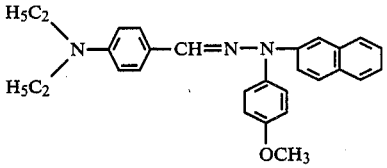
(V-19)
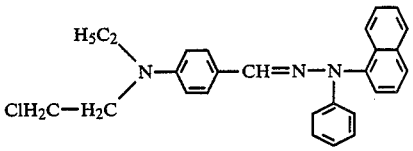
(V-20)
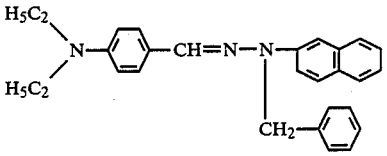
(V-21)
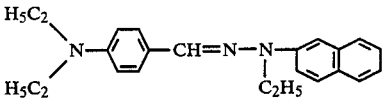
(V-22)
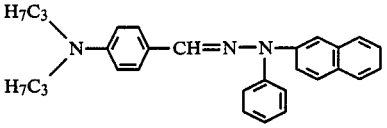
(23)
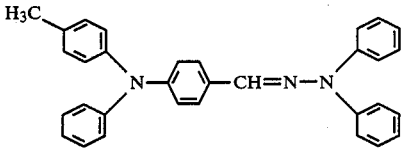

(VI-1)
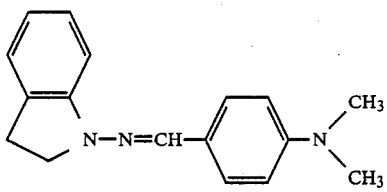
(VI-2)
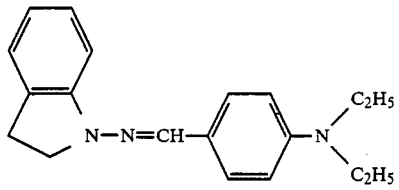
(VI-3)
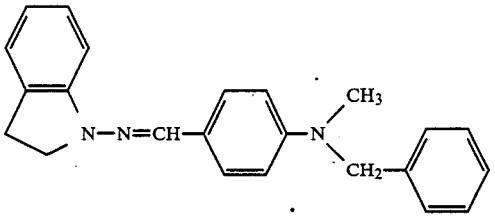
(VI-4)
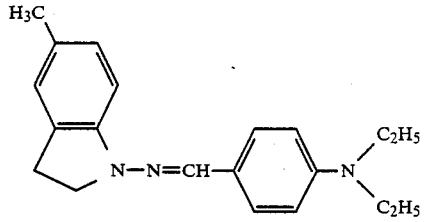
(VI-5)
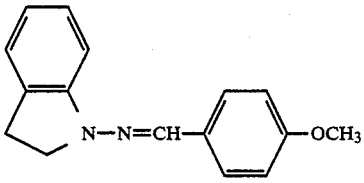
(VI-6)
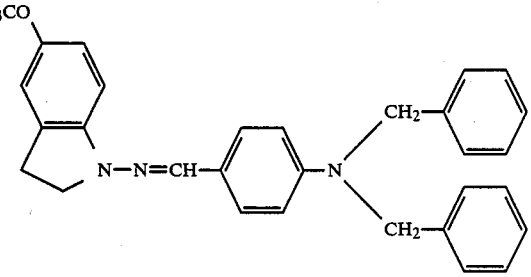
(VI-7)
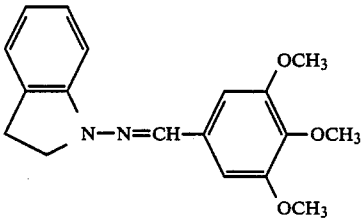
(VI-8)
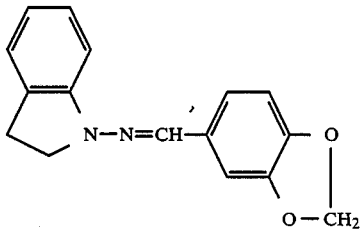
(VI-9)
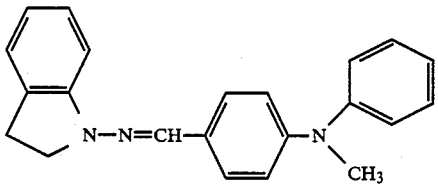
(VI-10)
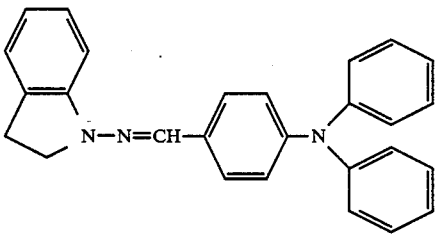
(VI-11)
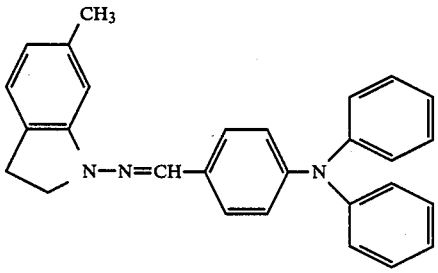
(VI-12)
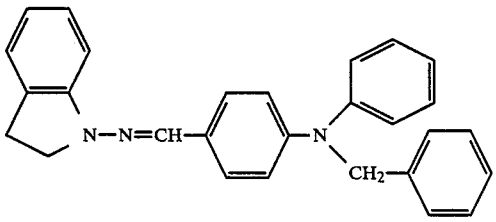

-continued
(VI-13)
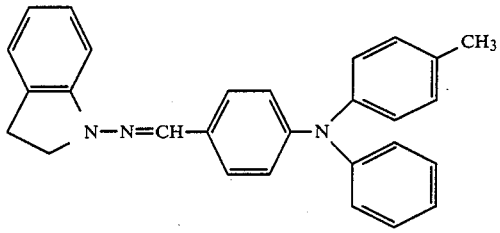
(VI-14)
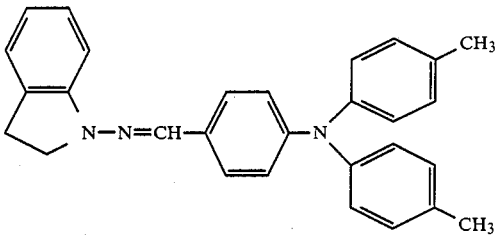
(VI-15)
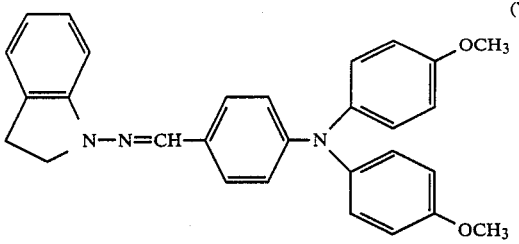
(VI-16)
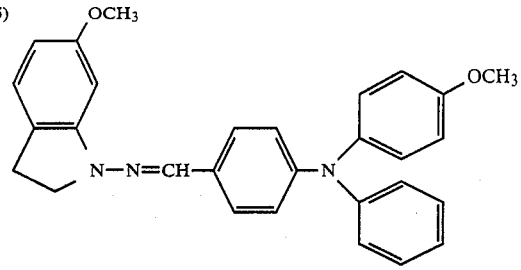
(VI-17)
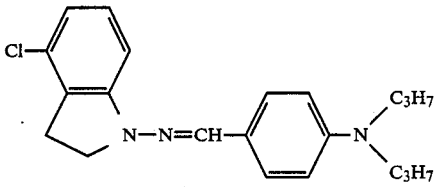
(VI-18)
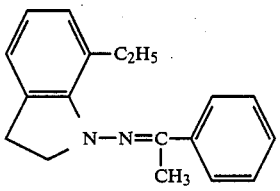
(VI-19)
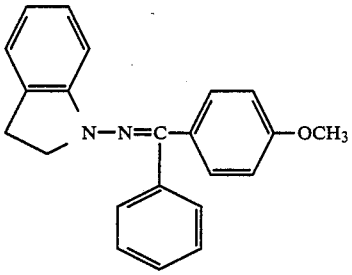
(VI-20)
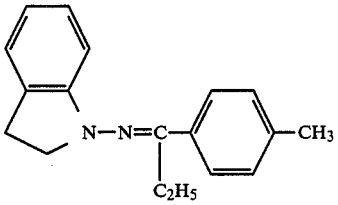
(VI-21)
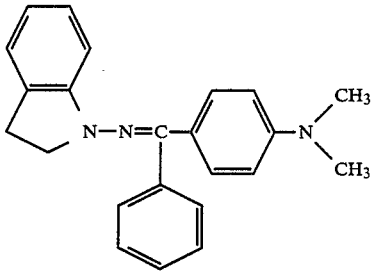
(VI-22)
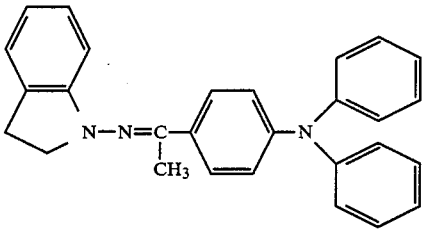
(VI-23)
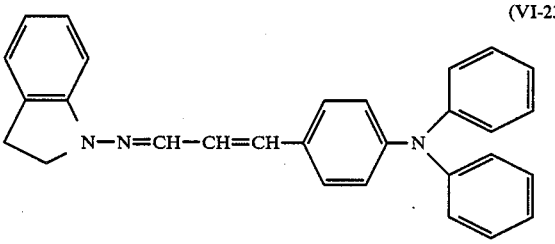
(VI-24)
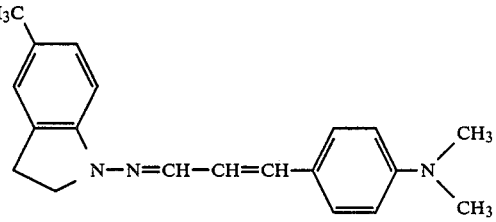

-continued
(VI-25)
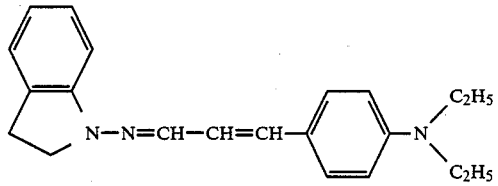
(VI-26)
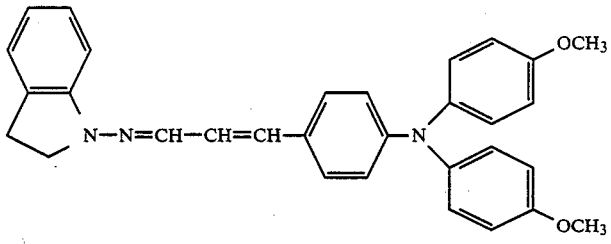
(VI-27)
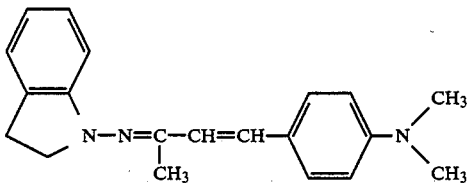
(VI-28)
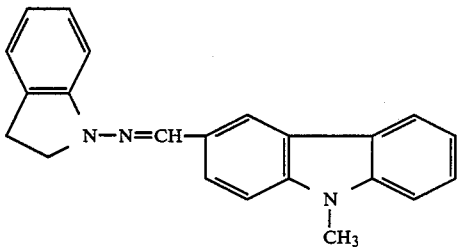
(VI-29)
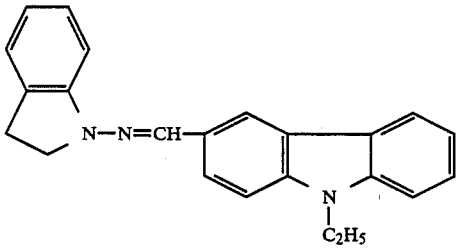
(VI-30)
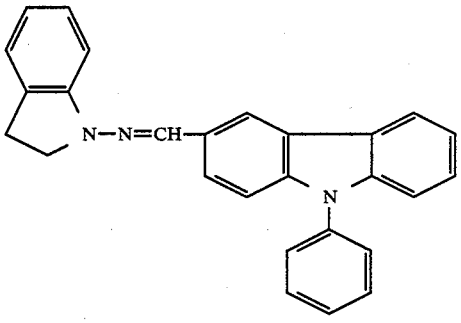
(VI-31)
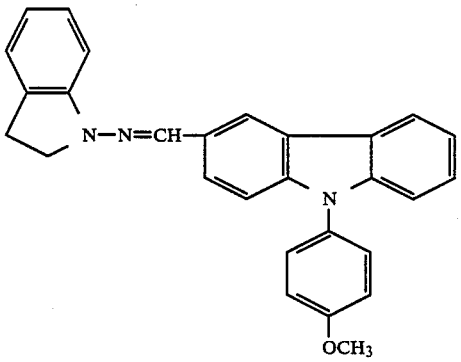
(VI-32)
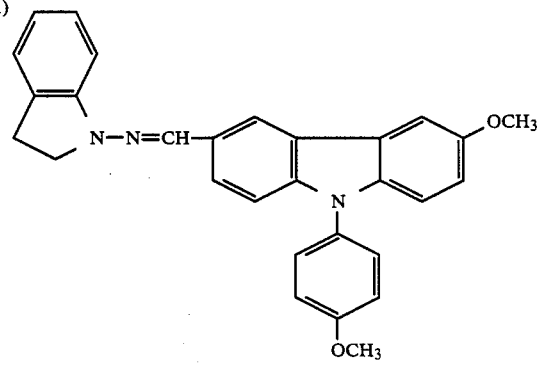

-continued
(VI-33)
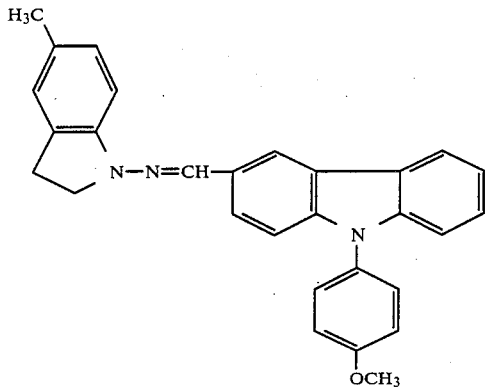
(VI-34)
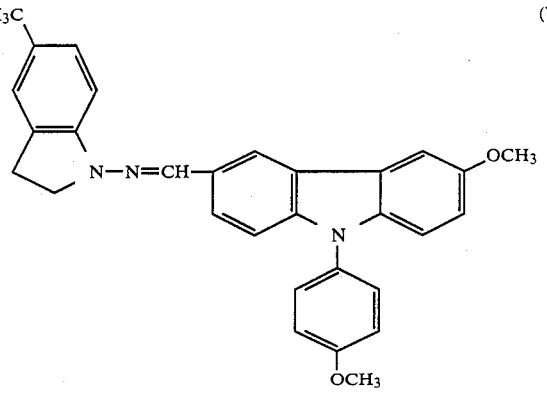
(VI-35)
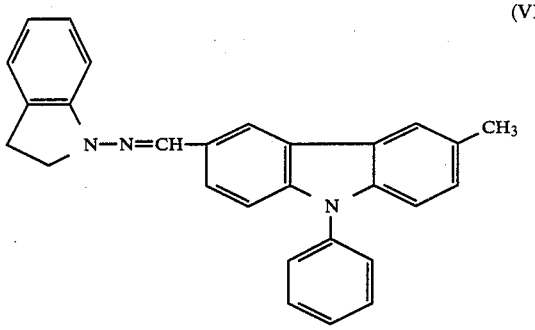
(VI-36)
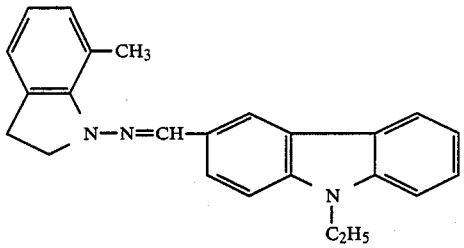
(VI-37)
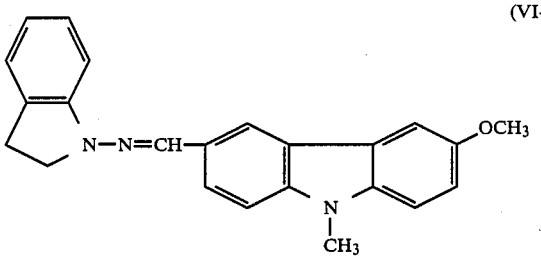
(VI-38)
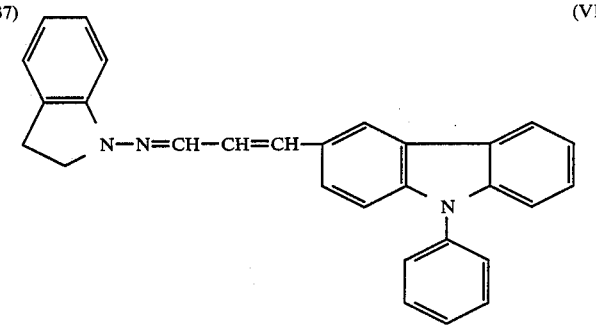
(VI-39)
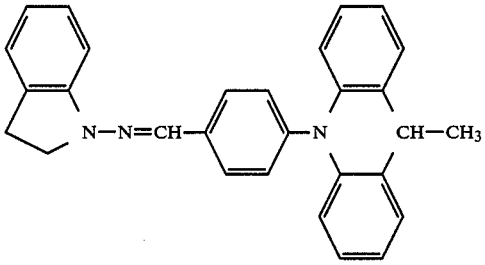
(VI-40)
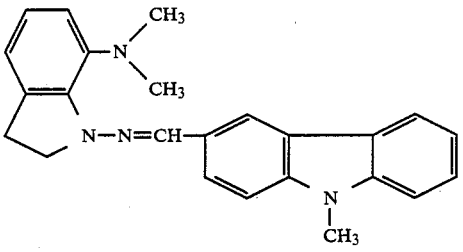
(VI-41)
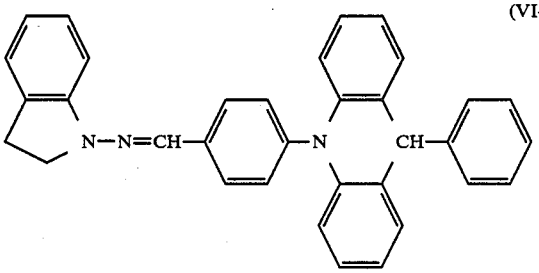
(VI-42)
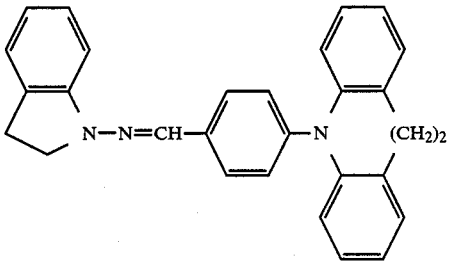

-continued
(VI-43)
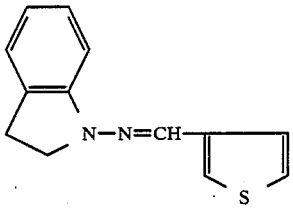
(VI-44)
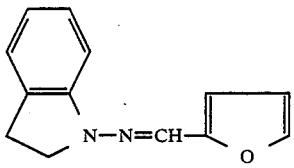
(VI-45)
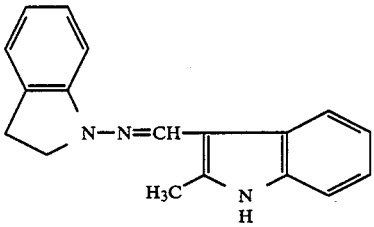
(VI-46)
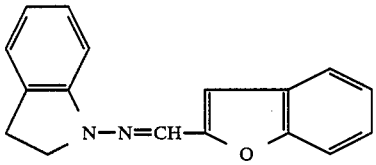
(VI-47)
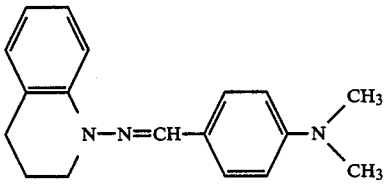
(VI-48)
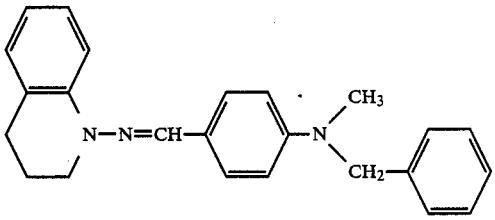
(VI-49)
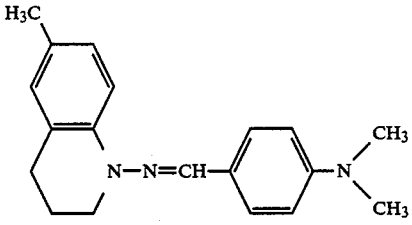
(VI-50)
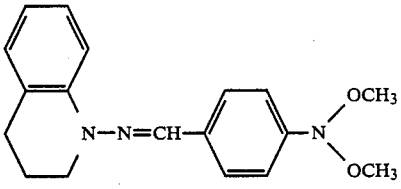
(VI-51)
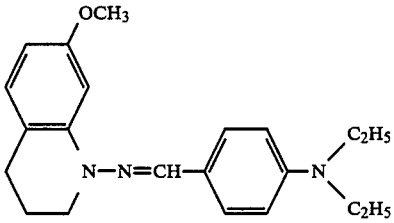
(VI-52)
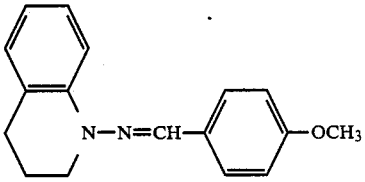
(VI-53)
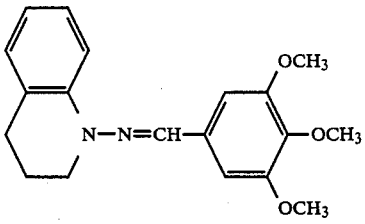
(VI-54)
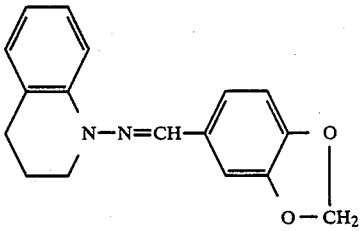
(VI-55)
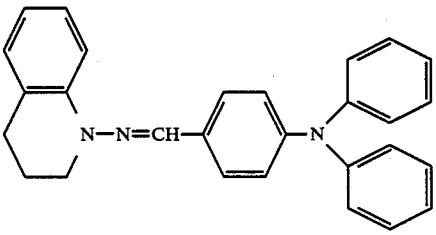
(VI-56)
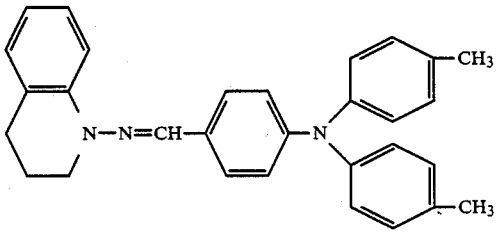

-continued
(VI-57)
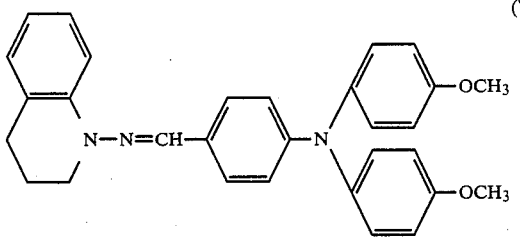
(VI-58)
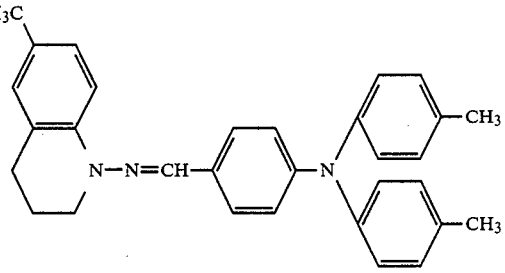
(VI-59)
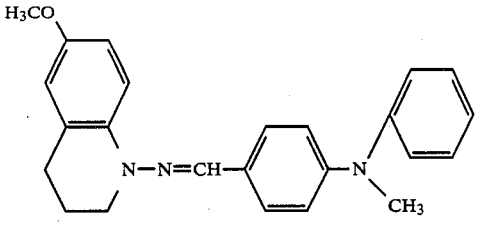
(VI-60)
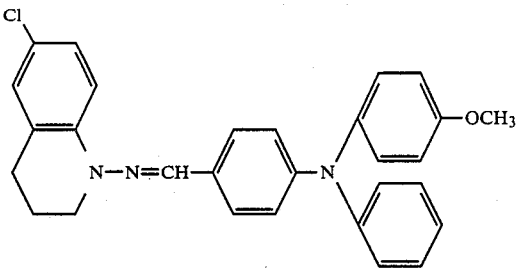
(VI-61)
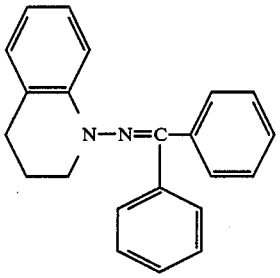
(VI-62)
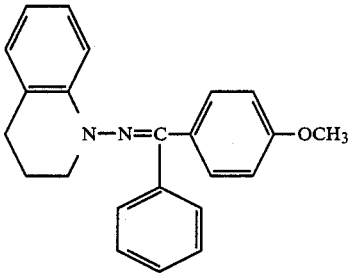
(VI-63)
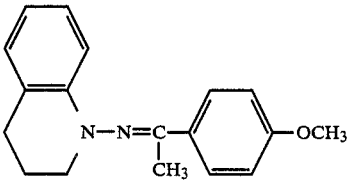
(VI-64)
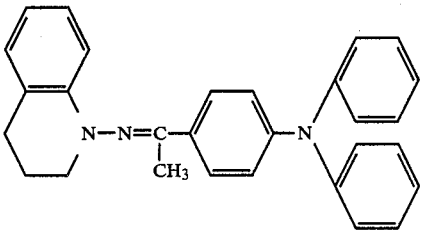
(VI-65)
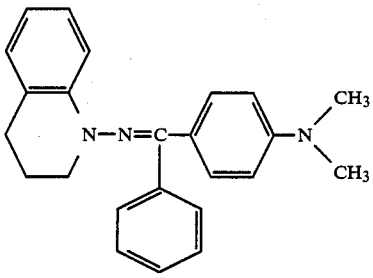
(VI-66)
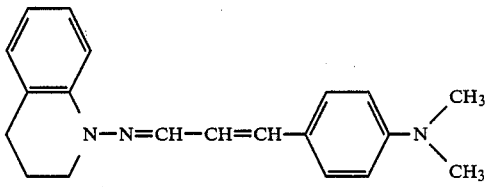
(VI-67)
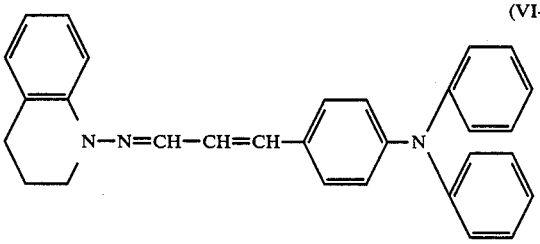
(VI-68)
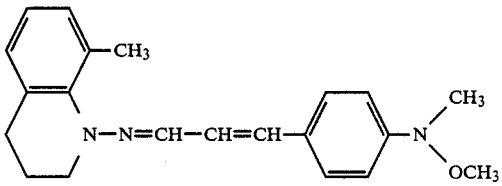

-continued
(VI-69)
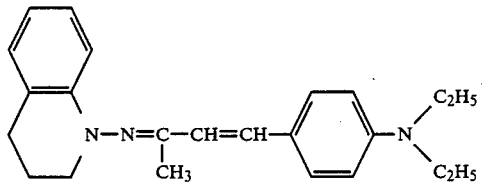
(VI-70)
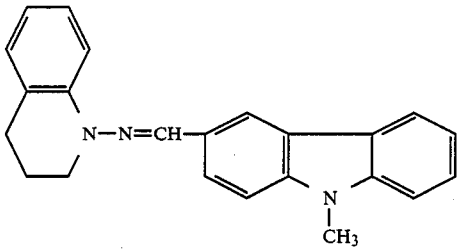
(VI-71)
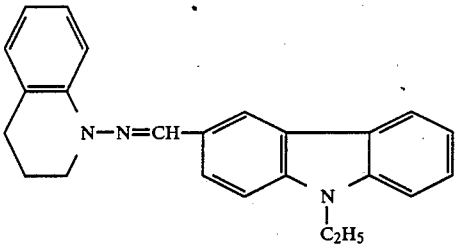
(VI-72)
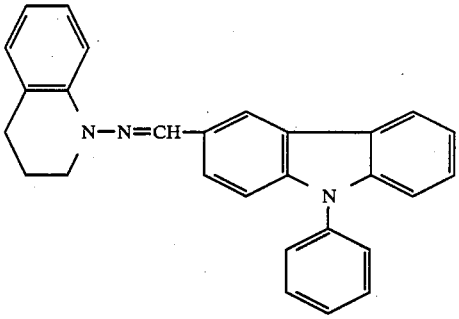
(VI-73)
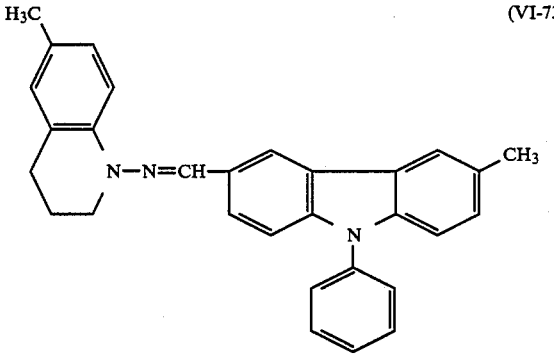
(VI-74)
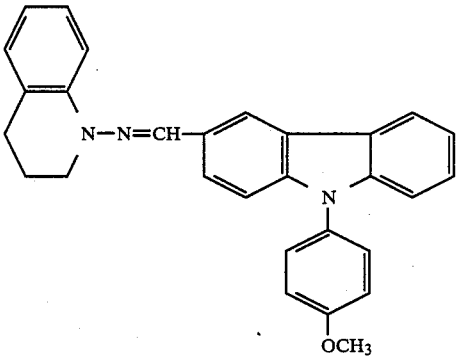
(VI-75)
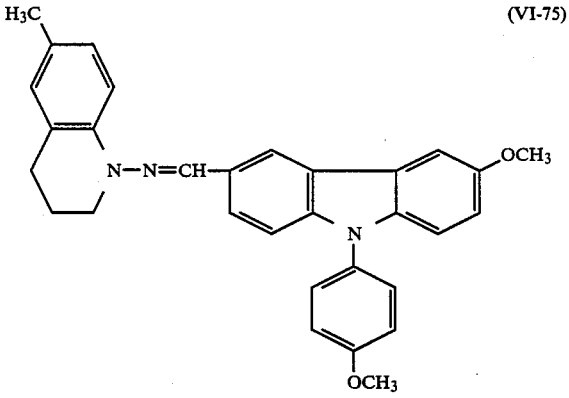
(VI-76)
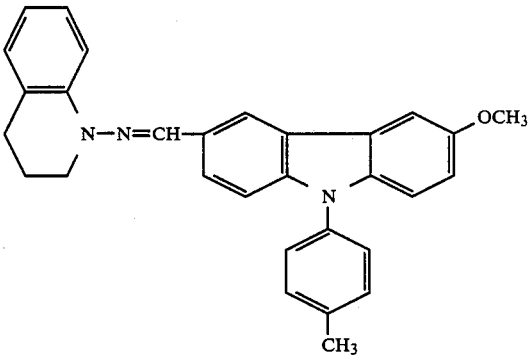
(VI-77)
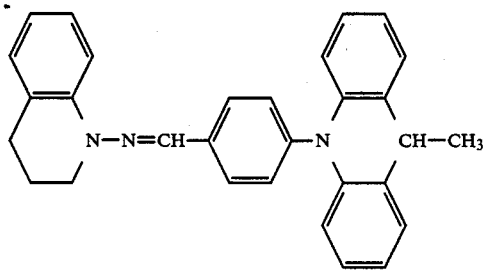
(VI-78)
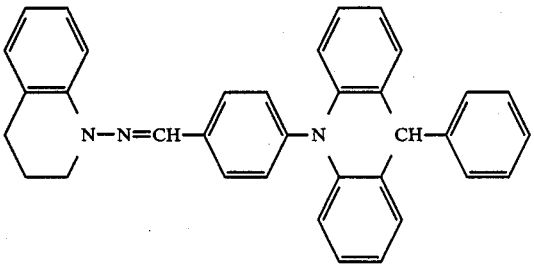

-continued (VI-79)

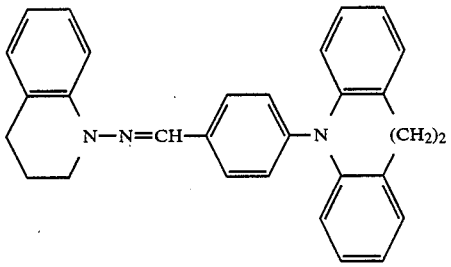

(VI-80)

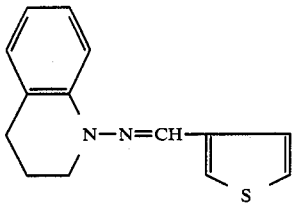

(VI-81)

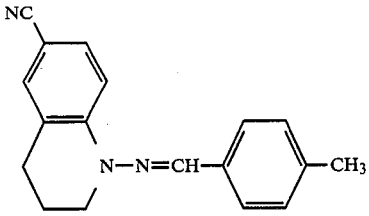

(VI-82)

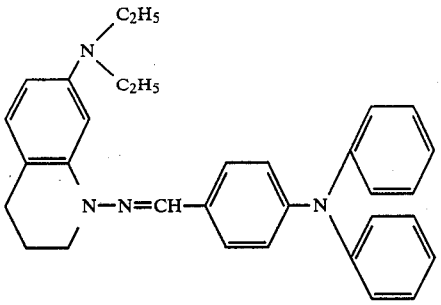

(VI-83)

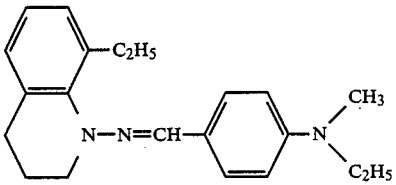

(VI-84)

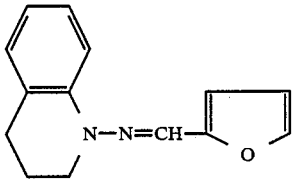

(VI-85)

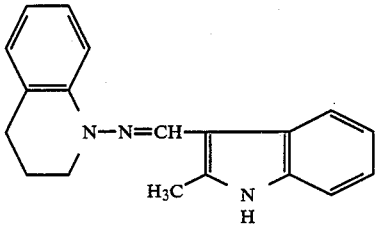

(VI-86)

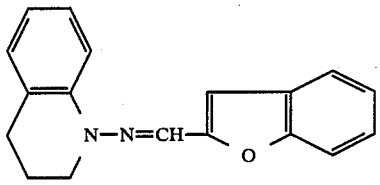

(VI-87)

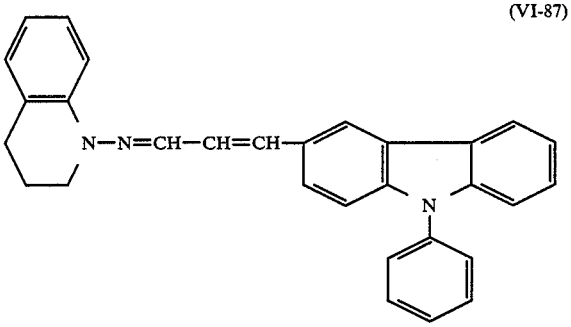

(VI-88)

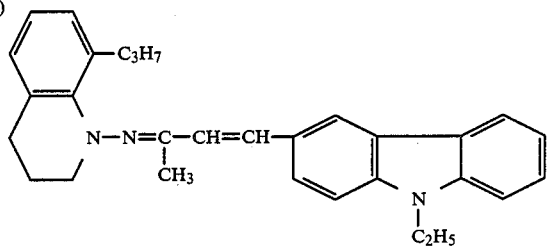

Also, as the carrier transporting substance, pyrazoline compounds represented by the following formula [VII] can be used.

[VII]

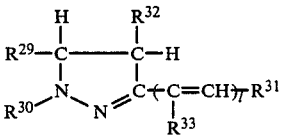

(wherein 1 represents 0 or 1; $R^{29}$, $R^{30}$ and $R^{31}$ each represent a substituted or unsubstituted aryl group or a substituted or unsubstituted heterocyclic group; and $R^{32}$ and $R^{33}$ each represent a hydrogen atom, an alkyl group having 1 to 4 carbon atoms, a substituted or unsubstituted aryl group or aralkyl group.)

Specific examples of the pyrazoline compounds are shown below.

(VII-1)
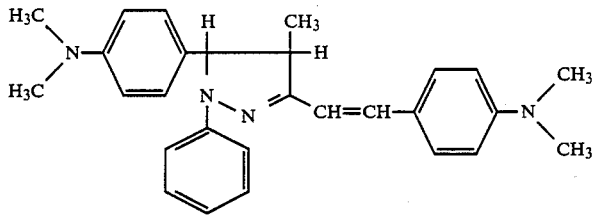
(VII-2)
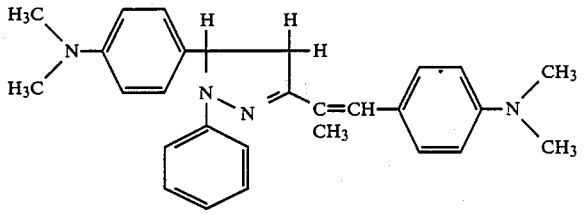
(VII-3)
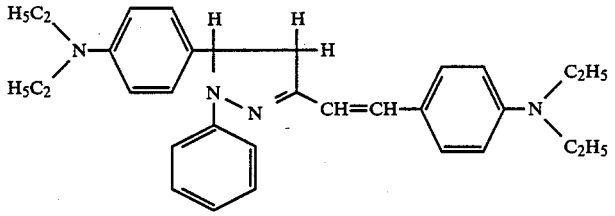
(VII-4)
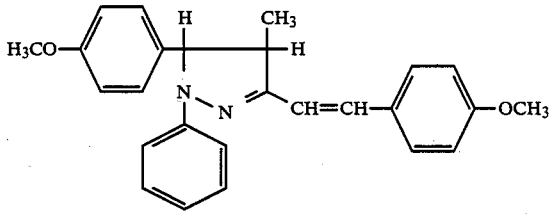
(VII-5)
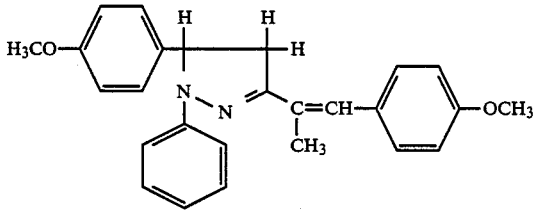
(VII-6)
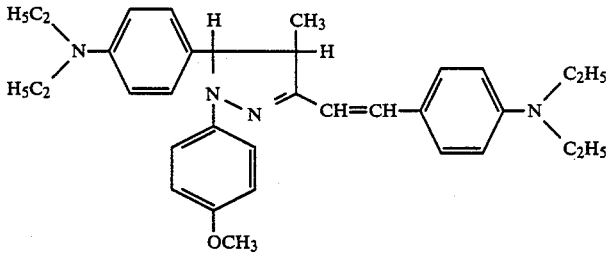
(VII-7)
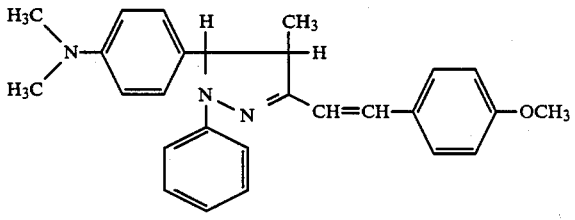

-continued
(VII-8)
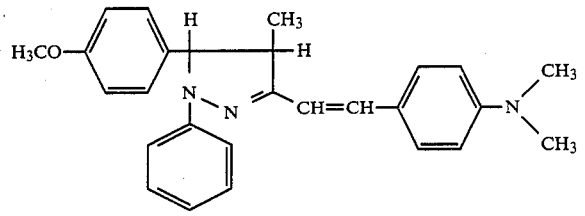
(VII-9)
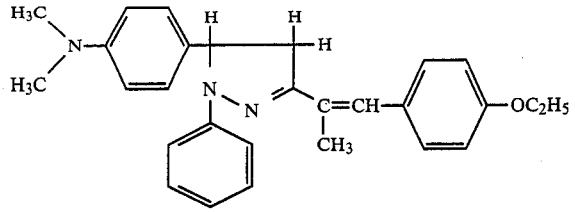
(VII-10)
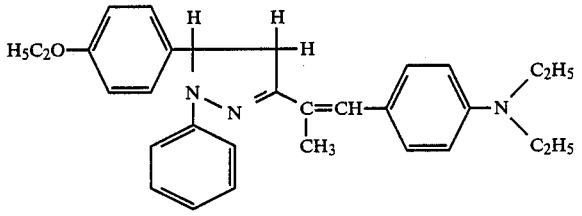
(VII-11)
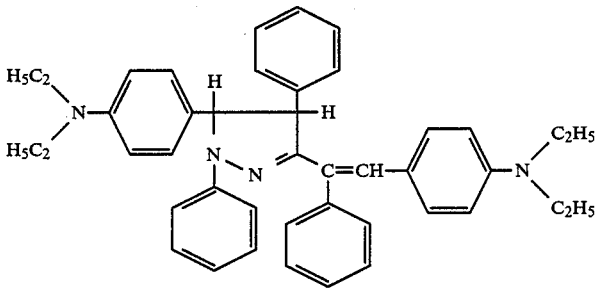
(VII-12)
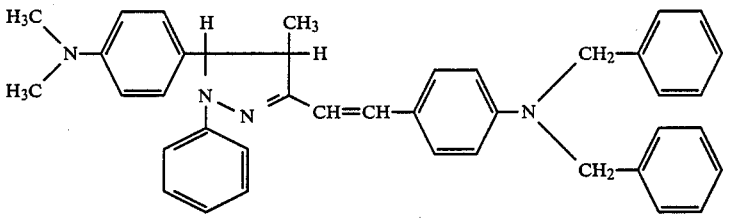
(VII-13)
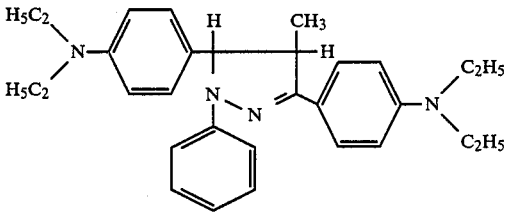

-continued
(VII-14)
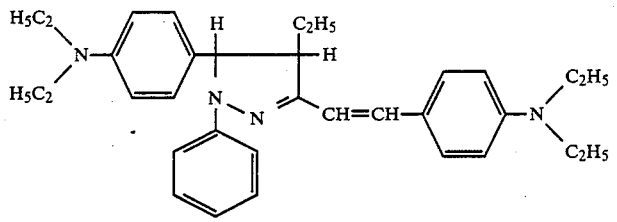
(VII-15)
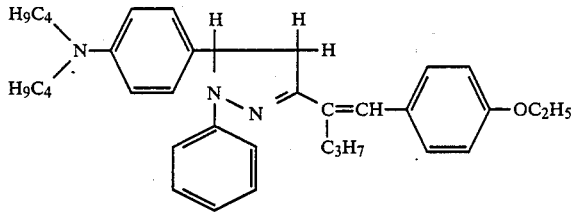
(VII-16)
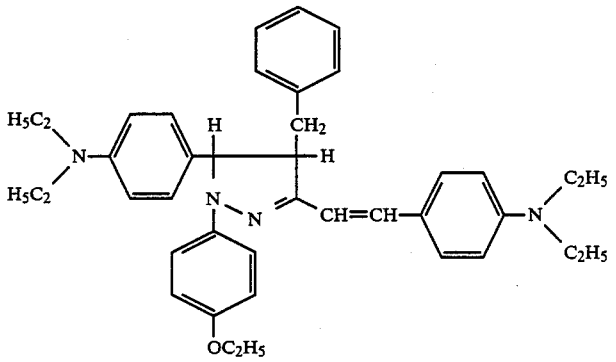
(VII-17)
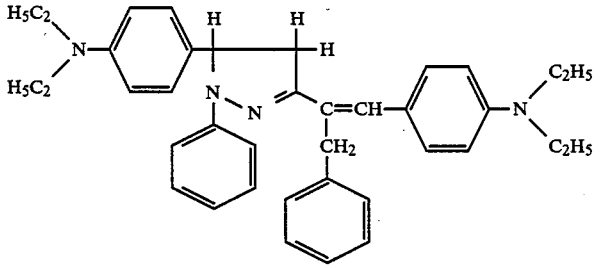
(VII-18)
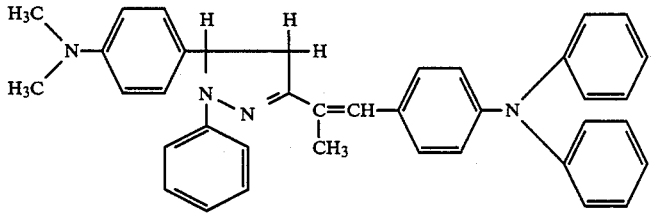
(VII-19)
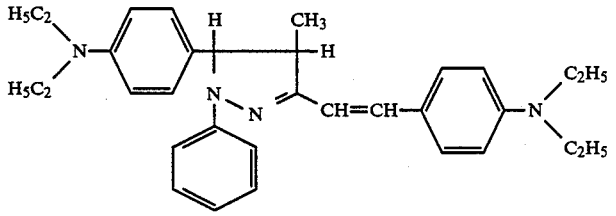
Further, amine derivatives represented by the following formula [VIII] can be used as the carrier transporting substance.

[VIII]

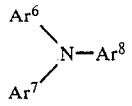

(wherein $Ar^6$ and $Ar^7$ each represent a substituted or unsubstituted phenyl group and the substituents may be a halogen atom, an alkyl group, a nitrog group or an alkoxy group; and $Ar^8$ represents a substituted or unsubstituted phenyl group, a naphthyl group, an anthryl group, a fluorenyl group or a heterocyclic group and the substituent may be an alkyl group, an alkoxy group, a halogen atom, a hydroxy group, an aryloxy group, an aryl group, an amino group, a nitro group, a pyperidino group, a morpholino group, a naphthyl group, an anthryl group or a substituted amino group, provided that the subsitutents for the substituted amino group may be an acyl group, an alkyl group, an aryl group or an aralkyl group.)

Specific examples of the amine derivatives are shown below.

(VIII-1)

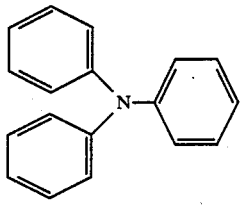

(VIII-2)

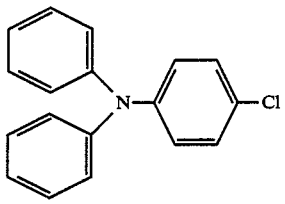

(VIII-3)

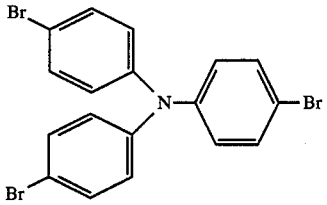

(VIII-4)

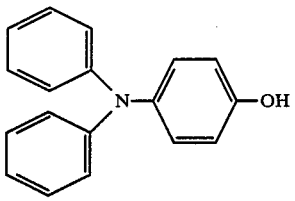

(VIII-5)

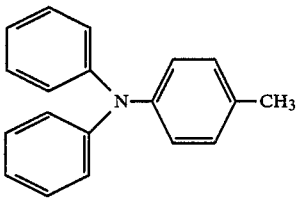

-continued (VIII-6)

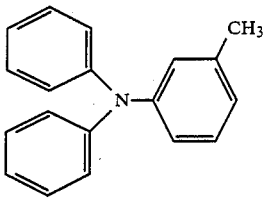

(VIII-7)

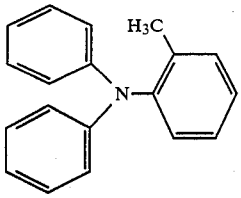

(VIII-8)

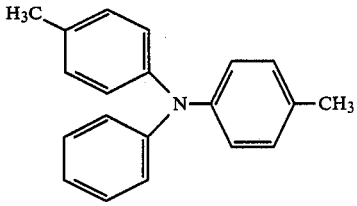

(VIII-9)

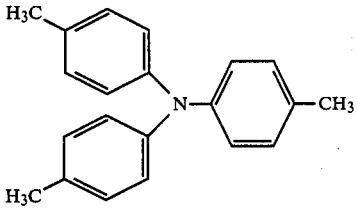

(VIII-10)

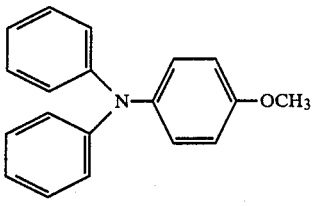

(VIII-11)

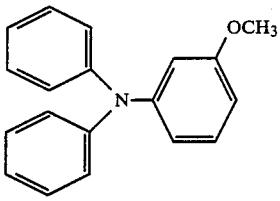

(VIII-12)

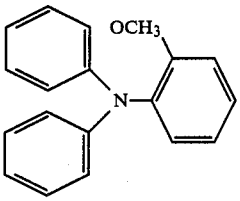

-continued
(VIII-13)
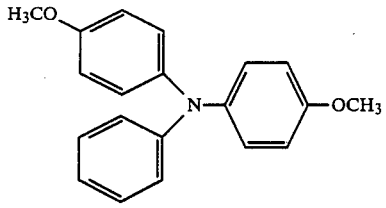
(VIII-14)
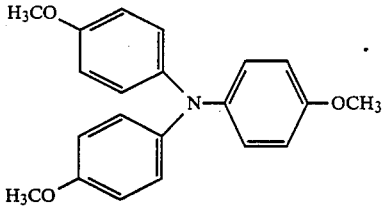
(VIII-15)
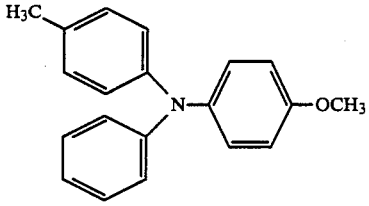
(VIII-16)
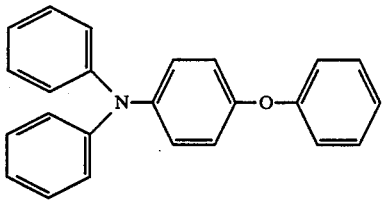
(VIII-17)
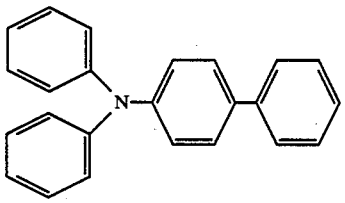
(VIII-18)
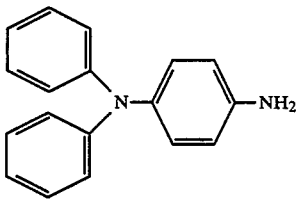
(VIII-19)
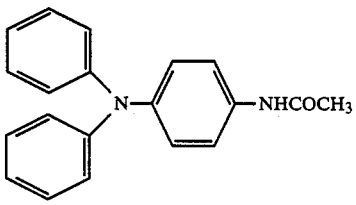
-continued
(VIII-20)
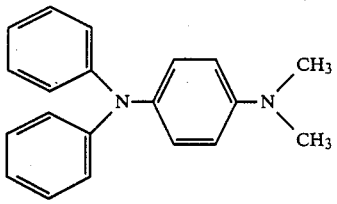
(VIII-21)
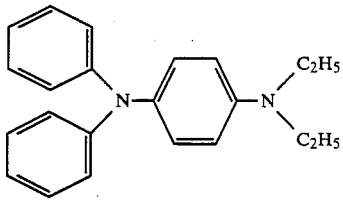
(VIII-22)
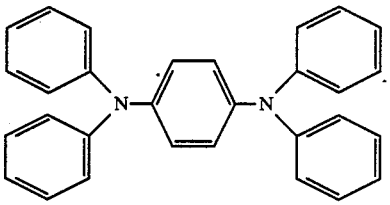
(VIII-23)
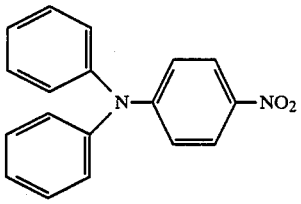
(VIII-24)
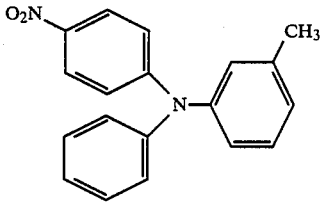
(VIII-25)
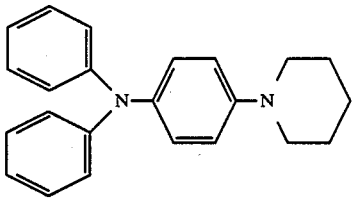
(VIII-26)
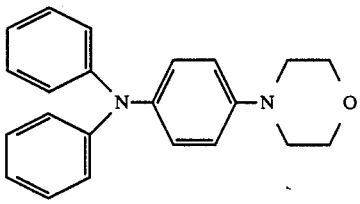

-continued (VIII-27)

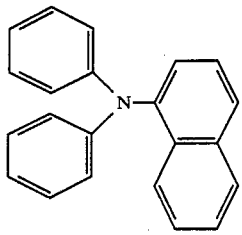

(VIII-28)

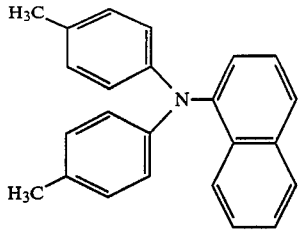

(VIII-29)

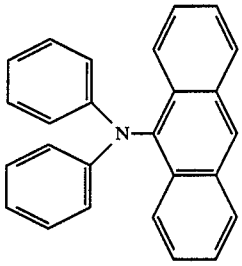

(VIII-30)

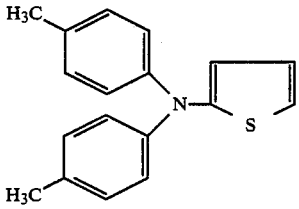

(VIII-31)

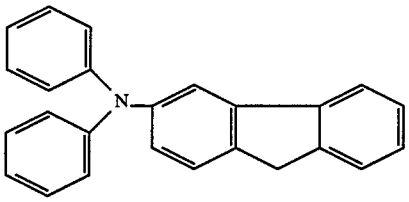

(VIII-32)

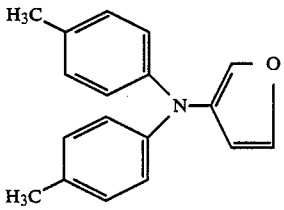

-continued (VIII-33)

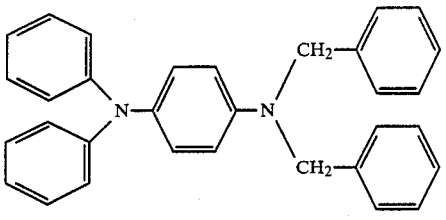

Examples of the binder resin available in the present invention may include addition polymerization type resins, polyaddition type resins, polycondensation type resins such as polyethylene, polypropylene, an acrylic resin, a methacrylic resin, a vinyl chloride resin, a vinyl acetate resin, an epoxy resin, a polyurethane resin, a phenol resin, a polyester resin, an alkyd resin, a polycarbonate resin, a silicon resin, a melamine resin, etc., and also copolymer resins containing two or more recurring units of these resins, such as vinyl chloride-vinyl acetate copolymer resin, vinyl chloride-vinyl acetate-maleic anhydride copolymer resin, etc., which are insulating resins, or otherwise polymeric organic semiconductors such as poly-N-vinylcarbazole, etc. However, the binder resin is not limited to these, but all the resins which can be generally used for such uses can be employed.

Figure 1:
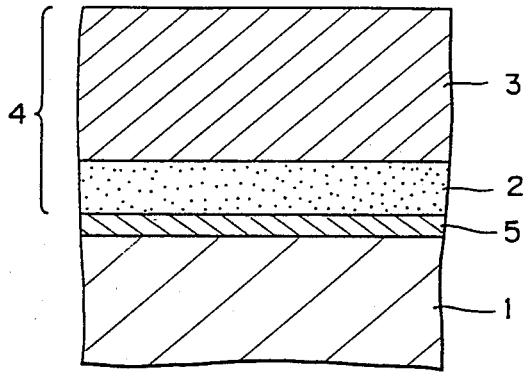
FIG. 1 is a sectional view of a portion of each exanple of electrophotographic photoreceptor.
Figure 8:
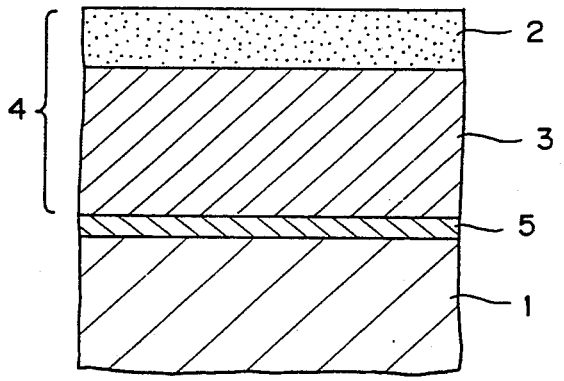
FIG. 8 is a sectional view of an electrophotographic photoreceptor.

The electrophotographic photoreceptor based on the present invention is illustratively constituted as shown in FIG. 1 or FIG. 8. That is, on an electroconductive support 1, a photosensitive layer 4 comprising a laminate having a carrier generating layer 2 with a thickness of 0.6 μm or more comprising the above particulate carrier generating substance (brominated anthanthrone dispersed in the layer containing the above carrier transporting substance as the main component and the carrier transporting layer 3 comprising the above carrier transporting substance arranged as upper and lower layers is provided. In the constitution in FIG. 1 or FIG. 8, if necessary, an intermediate layer 5 may be provided between the electroconductive support 1 and the photosensitive layer 4.

When forming a photosensitive layer by dispersing the above particulate carrier generating substance, said carrier generating substance should preferably be formed into powdery particles with a mean particle size of 2 μm or less, preferably 1 μm or less. More specifically, if the particle size is too great, the particles can be poorly dispersed into the layer and at the same time a part of the particles are protruded on the surface to worsen smoothness of the surface whereby discharging may be sometimes caused at the protruded portions of the particles or the toner particles may be attached thereat to cause readily the toner filming phenomenon.

However, if the above particle size is too small then agglomeration will more readily occur to bring about elevation of the resistance of the layer, increase the crystal defects to lower sensitivity and repeating characteristics, or there is limiation in communitation. Therefore the lower limit of the mean particle size should be desirably be 0.01 μm.

The photosensitive layer can be provided according to the method as described below. That is, the carrier generating substance as described above is formed into fine particles into a dispersing medium by means of a ball mill, homomixer, etc., then a binder resin and a carrier transporting substance are added, followed by mixing and dispersing, and the resultant dispersion is coated. In this method, when the particles are dispersed under the action of sonication, uniform dispersion can be obtained. The carrier transporting layer can be also formed by coating of a solution of the carrier transporting substance.

As the dispersing medium to be used for formation of the layer, there may be employed N,N-dimethylformamide, benzene, toluene, xylene, 1,2-dichloroethane, dichloromethane, tetrahydrofuran, etc.

When a binder resin is used for formation of the photosensitive layer, any desired resin may be used as said binder resin, but it is particularly preferable to use a film forming polymer which is hydrophobic and electrically insulating having a high dielectric constant.

Further, for the purpose of improving sensitivity, lowering residual potential or fatique during repeated uses, it is possible to incorporate one kind or two or more kinds of electron accepting substances in the above photosensitive layer. Examples of the electron accepting substances which can be used here may include succinic anhydride, maleic anhydride, debromomaleic anhydride, phthalic anhydride, tetrachlorophthalic anhydride, tetrabromophthalic anhydride, 3-nitrophthalic anhydride, 4-nitrophthalic anhydride, pyromellitic anhydride, mellitic anhydride, tetracyanoethylene, tetracyanoquinodimethane, o-dinitrobenzene, m-dinitrobenzene, 1,3,5-tri-nitronebenzene, p-nitrobenzonitrile, pycryl chloride, quinonechloroimide, chloranil, bromamil, dichlrodicyano-p-benzoquinone, anthraquinone, dinitroanthraquinone, 9-fluorenylidene[dicyanomethylenemalonodinitrile], polynitro-9-fluorenylidene-[dicyanomethylenemalonodinitrile], pycric acid, o-nitrobenzoic acid, p-nitrobenzoic acid, 3,5-dinitrobenzoic acid, pentafluorobenzoic acid, 5-nitrosalicylic acid, 3,5-dinitrosalicylic acid, phthalic acid, mellitic acid, and other compounds having great electron affinity. The proportion of the electron accepting substance added may be carrier generating substance:electron accepting substance=100:0.01 to 200, preferably 100:0.1 to 100, in terms of weight ratio.

The support 1 on which the photosensitive layer as described above is to be provided may comprise an electroconductive thin layer comprising a metal plate, a metal drum or an electroconductive polymer, an electroconductive compound such as indium oxide, etc., or a metal such as aluminum, palladium, gold, etc., provided on a substrate such as paper, plastic film, etc., by means of coating, vapor deposition, lamination, etc. As the intermediate layer which can function as the adhesive layer or the barrier layer, etc., those comprising the polymers as described above for the binder resin, organic polymeric substances such as polyvinyl alcohol, ethyl cellulose, carboxymethyl cellulose, etc., or aluminum oxide may be used.

As the organic solvent to be used for formation of the photosensitive layer of the present invention there may be employed, for example, single solvents such as methylene chloride, methylene bromide, 1,2-dichloroethane, sym-tetrachloroethane, cis-1,2-dichoroethylene, 1,1,2-trichloroethane, choroform, bromoform, dioxane, tetrahydrofuran, pyridine, etc., or various mixed solvents containing these as the main component.

EXAMPLES

The present invention is described in more detail about specific Examples with reference to Comparative examples.

EXAMPLE 1

Figure 9:
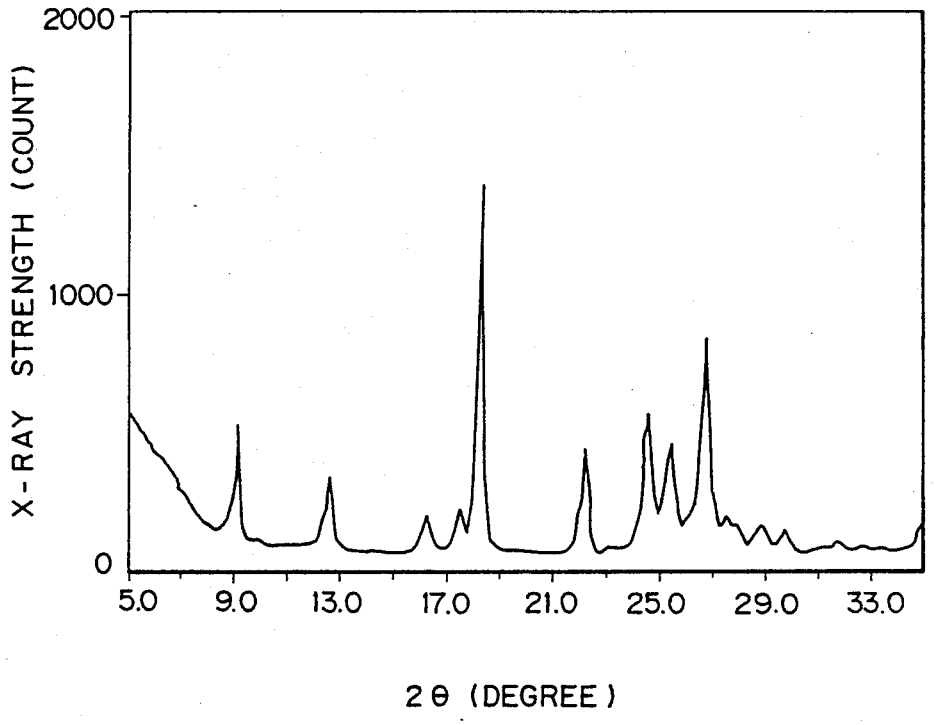
FIG. 9 is an X-ray diffraction spectrum chart of a carrier generating substance before pulverization.

An amount of 50 g of the fine powdery brominated anthanthrone obtained by bromination of anthanthrone in sulfuric acid followed by pouring into water was added into a borderline solvent comprising 100 ml of nitrobenzene and 2 ml of $H_2SO_4$, and the mixture was stirred slowly at 100° C. for 24 hours and then left to cool. Subsequently, the mixture was subjected to filtration and washing to give 48.3 g of a highly crystalline brominated anthanthrone pigment. The X-ray diffraction spectrum of the purified pigment (measured by JDX10RA, produced by Nippon Denshi, CuK$\alpha$ 1.541 A) is shown in FIG. 9.

The purified pigment obtained (40 g) was filled in a ball mill made of a porcelain and pulverized at 20 rpm (the critical rotational number for giving the maximum pulverizing energy was 70 rpm) for 24 hours.

Next, a solution of 20 g of a polycarbonate resin "Panlite L-1250" (produced by Teijin Kasei Co.) dissolved in 1300 ml of 1,2-dichloroethane was added, followed by dispersing treatment, to obtain a coating liquid for formation of a carrier generating layer.

By use of a part of the coating liquid obtained, the pigment was separated by filtration and subjected to measurement of the strengths of the X-ray diffraction spectrum at 20=18.4° and 26.7° to obtain the results as shown in Table 1. Also, the mean value b/a of the long axis, short axis ratio and the mean valve b of the long axis of the purified pigment and the pigment in the coating liquid after pulverization and dispersion are shown in Table 1.

EXAMPLE 2

Example 1 was repeated except that the ball mill pulverization time was changed to 12 hours in Example 1.

EXAMPLE 3

Example 1 was repeated except that the pulverization time was changed to 96 hours.

COMPARATIVE EXAMPLE 1

Example 1 was repeated except that the pulverization time was changed to 6 hours.

COMPARATIVE EXAMPLE 2

Example 1 was repeated except that the pulverization time was changed to 120 hours.

COMPARATIVE EXAMPLE 3

According to the same procedure as in Example 1, except for dispersing the starting material for 24 hours, which was applied with no crystallization treatment used in Example 1, a coating liquid for formation of a carrier generating layer was obtained.

TABLE 1

| Sample No. | X-ray diffraction strength (counts) S(18.4°) | S(26.7°) | Strength ratio S(18.4°)/S(26.7°) | Long axis/short axis ratio b/a | Long axis length b (μ) | Pulverization time (hr) |
|---|---|---|---|---|---|---|
| Unpulverized product | 13920 | 8190 | 1.7 | 6.8 | 11.5 | 0 |
| Example 1 | 2720 | 3490 | 0.78 | 2.8 | 0.9 | 24 |
| Example 2 | 3860 | 4190 | 0.92 | 3.3 | 1.8 | 12 |
| Example 3 | 960 | 3180 | 0.30 | 1.7 | 0.3 | 96 |
| Comparative example 1 | 5610 | 4840 | 1.16 | 4.3 | 5.6 | 6 |
| Comparative example 2 | 550 | 3070 | 0.18 | 1.08 | 0.1 | 120 |
| Comparative example 3 | 340 | 2060 | 0.17 | 1.06 | 0.3 | 0 |

By use of the coating liquids for formation of carrier generating layer obtained in the above Examples and Comparative examples, electrophotographic photosensitive drums were prepared according to the method described below.

On a 100 $\phi$ aluminum drum, an intermediate layer comprising a vinyl chloride-vinyl acetate-maleic anhydride copolymer resin "S-lec MF-10" (trade name, produced by Sekisui Kagaku Kogyo Co.) with a dry weight of 0.1 g/m$^2$ was provided by dip coating, and then the above coating liquid for formation of a carrier generating layer was applied by dip coating on the above intermediate layer to obtain a carrier generating layer with a dry weight of 2.1 g/m$^2$.

On the other hand, a coating solution for formation of carrier transporting layer obtained by dissolving 225 g of a carrier transporting substance represented by the following formula:

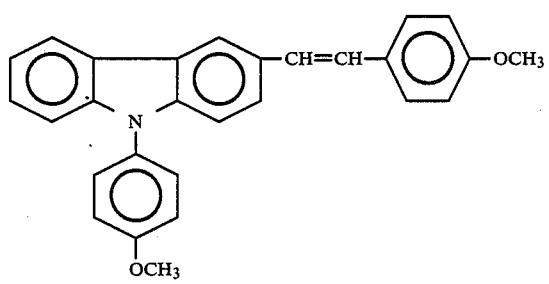

0.225 g of 2,4,6-trinitro-1-chlorobenzene and 300 g of a polycarbonate resin in 2000 ml of 1,2-dichloroethane was applied by dip coating of the above carrier generating layer to form a carrier transporting layer with a dry weight of 19 g/m$^2$. Thus, electrophotographic photosensitive members of the present invention and Comparative example (FIG. 1) were prepared.

Alternatively, in place of the above description, a carrier transporting layer may be first formed and then a carrier generating layer may be formed thereon (FIG. 8).

The samples and conparative samples obtained in the above Examples and Conparative examples were mounted on a photoreceptor tester (produced by Konishiroku Photo Industry Co.) and, by use of a surface potentiometer "Electrostatic voltometer 144D-1D model" (produced by Monroe Electronics Inc.), the charging potential Vo (V), the exposure dose $E_{100}^{600}$ (lx sec) necessary for reducing the surface potential from −600 V to −100 V and the potential retentivity DD (%) after 5 seconds after the surface potential was made −600 V were examined.

Also, repeated test for 5000 times was performed for examination of stability of the charging potential.

For samples of which charging potential was less than 600 V, the charging current was increased than the standard value and $E_{100}^{600}$ and DD were measured thereat.

The results are shown in Table 2 (Sample No. in Table 2 correspond to Example No. and Conparative example No. in Table 1).

TABLE 2

| Sample No. | Surface potential (V) Initial | After 5000 copying | Lowered quantity | $E_{100}^{600}$ (lx · sec) | DD (%) |
|---|---|---|---|---|---|
| Example 1 | −850 | −830 | 20 | 8.0 | 83 |
| Example 2 | −985 | −975 | 10 | 8.6 | 89 |
| Example 3 | −745 | −710 | 35 | 7.8 | 75 |
| Comparative example 1 | −1045 | −1025 | 20 | 11.3 | 91 |
| Comparative example 2 | −560 | −505 | 55 | 9.7 | 69 |
| Comparative example 3 | −440 | −375 | 65 | 16.2 | 58 |

From Table 1 and Table 2, it can be appreciated that sensitivity and potential retaining performance are good in samples according to the present invention.

EXAMPLES 4 to 19

On an electroconductive support comprising a polyester film laminated with an aluminum foil, an intermediate layer comprising a vinyl chloride-vinyl acetate-maleic anhydride copolymer "S-lec MF-10" (trade name, produced by Sekisui Kagaku Co.) with a thickness of 0.05 μm was formed. Subsequently, a solution of the carrier transport substance and the binder resin as shown in Table 3 dissolved in 67 ml of 1,2-dichloroethane was applied on the above intermediate layer to form a carrier transport layer.

Next, a dispersion obtained by dispersing the brominated anthanthrone and each carrier transporting substance as shown in Table 3 together with a binder resin in 67 ml of 1,2-dichloroethane by means of a ball mill for 12 hours was applied and dried on the above carrier transporting layer to form a carrier generating layer. Thus, respective electrophotographic photosensitive members were prepared.

The thus obtained electrophotographic photoreceptor was mounted on an electrostatic tester "SP-428 model" (produced by Kawaguchi Denki Seisakusho) and the following characteristic tests were performed.

More specifically, a voltage of +6 KV was applied on a charger to charge the photosensitive layer by corona discharging for 5 seconds, and then the photoreceptor was left to stand for 5 seconds (the potential at this time is defined as $V_1$). Subsequently, light was irradiated from a tungsten lamp under the state where the luminosity of the surface of the photosensitive layer becomes 35 lux, and the a dose necessary for attenuating the surface potential of the photosensitive layer to ½, namely the half-reduction dose $E_{\frac{1}{2}}$ was determined. Also, the recepter voltage $V_A$ during charging by the above corona discharing, $E_{\frac{1}{2}}$ and residual potentials $V_R$ at the initial stage and after copying for 10,000 times were measured.

According to these results, it can be appreciated that every one of the samples of Examples based on the present invention (No. 4 to No. 19) exhibits considerably better electrophotographic characteristics as compared with Comparative examples Nos. 4 to 5.

Particularly, it is important to select the ratio of the carrier transporting substance/carrier generating substance in the carrier generating layer at 0.2 to 3.0, further at 0.4 to less that 2.0. Also, in spite of much amount of the carrier generating substance, it can be seen that the electrophotographic characteristics are good and stability with lapse of time is excellent.

TABLE 3

| | Carrier generating layer | | | | | | | Carrier transporting layer | | | | | Evaluation items | | | | | |
|---|---|---|---|---|---|---|---|---|---|---|---|---|---|---|---|---|---|---|
| | Amount of carrier generating substance | Carrier transporting substance and amount thereof | | Carrier transporting substance/ carrier generating substance | Film thickness (μm) | Binder and amount thereof | | Amount of carrier transporting substance | | Binder and amount thereof | | Film thickness (μm) | | | | After 10,000 copying | | |
| | | | | | | | | | | | | | $V_A$ | $E_{\frac{1}{2}}$ | $V_{E\frac{1}{2}}$ | $V_R$ | | |
| Example 4 | 2.0 g | I-54 | 0.4 g | 0.2 | 5.0 | PC | 4 g | I-54 | 7.5 g | PC | 10 g | 14 | +980 | 3.6 | 0 | +965 | 3.7 | 0 |
| Example 5 | 2.0 g | I-54 | 0.8 g | 0.4 | 5.0 | PC | 4 g | I-54 | 7.5 g | PC | 10 g | 14 | +960 | 3.5 | 0 | +940 | 3.7 | 0 |
| Example 6 | 2.0 g | I-54 | 2.0 g | 1.0 | 5.0 | PC | 4 g | I-54 | 7.5 g | PC | 10 g | 14 | +950 | 3.3 | 0 | +925 | 3.5 | 0 |
| Example 7 | 2.0 g | I-54 | 3.0 g | 1.5 | 5.0 | PC | 4 g | I-54 | 7.5 g | PC | 10 g | 14 | +930 | 3.2 | 0 | +905 | 3.4 | 0 |
| Example 8 | 2.0 g | I-54 | 4.0 g | 2.0 | 5.0 | PC | 4 g | I-54 | 7.5 g | PC | 10 g | 14 | +900 | 3.0 | 0 | +890 | 3.1 | 0 |
| Example 9 | 2.0 g | I-54 | 6.0 g | 3.0 | 5.0 | PC | 4 g | I-54 | 7.5 g | PC | 10 g | 14 | +870 | 3.1 | 0 | +860 | 3.3 | 0 |
| Example 10 | 2.0 g | V-23 | 3.0 g | 1.5 | 0.6 | PC | 3 g | V-23 | 7.5 g | PC | 10 g | 14 | +920 | 3.5 | 0 | +900 | 3.7 | +6 |
| Example 11 | 2.0 g | V-23 | 3.0 g | 1.5 | 1.0 | PC | 3 g | V-23 | 7.5 g | PC | 10 g | 14 | +945 | 2.9 | 0 | +920 | 3.2 | 0 |
| Example 12 | 2.0 g | V-23 | 3.0 g | 1.5 | 6.0 | PC | 3 g | V-23 | 7.5 g | PC | 10 g | 14 | +1020 | 3.4 | 0 | +995 | 3.5 | 0 |
| Example 13 | 2.0 g | V-23 | 3.0 g | 1.5 | 8.0 | PC | 3 g | V-23 | 7.5 g | PC | 10 g | 14 | +1095 | 4.0 | 0 | +1060 | 4.1 | 0 |
| Example 14 | 2.0 g | V-23 | 3.0 g | 1.5 | 10.0 | PC | 3 g | V-23 | 7.5 g | PC | 10 g | 14 | +1100 | 4.5 | 0 | +1025 | 4.6 | +5 |
| Example 15 | 2.0 g | III-1 | 3.0 g | 1.5 | 4.0 | PC | 3 g | III-1 | 7.5 g | PC | 10 g | 14 | +975 | 3.0 | 0 | +940 | 3.2 | 0 |
| Example 16 | 2.0 g | I-77 | 3.0 g | 1.5 | 4.0 | PC | 3 g | I-77 | 7.5 g | PC | 10 g | 14 | +960 | 3.2 | 0 | +925 | 3.4 | 0 |
| Example 17 | 2.0 g | II-14 | 3.0 g | 1.5 | 4.0 | PC | 3 g | II-14 | 7.5 g | PC | 10 g | 14 | +990 | 4.0 | 0 | +1050 | 4.2 | 0 |
| Comparative example 4 | 2.0 g | I-54 | 0.2 g | 0.1 | 5.0 | PC | 4 g | I-54 | 7.5 g | PC | 10 g | 14 | +975 | 5.0 | +10 | +990 | 7.4 | +30 |
| Comparative example 5 | 2.0 g | I-54 | 8.0 g | 4.0 | 4.0 | PC | 4 g | I-54 | 7.5 g | PC | 10 g | 14 | +680 | 3.4 | 0 | +620 | 5.8 | 0 |
| Example 18 | 2.0 g | I-54 | 2.0 g | 1.0 | 3.0 | PMMA | 4 g | I-54 | 7.5 g | PMMA | 10 g | 14 | +785 | 3.7 | 0 | +760 | 3.9 | 0 |
| Example 19 | 2.0 g | I-54 | 3.0 g | 1.5 | 4.0 | poly-ester | 4 g | I-54 | 7.5 g | PC | 10 g | 14 | +790 | 3.4 | 0 | +770 | 3.4 | 0 |

PC: polycarbonate (Panlite L-1250, trade name)

PMMA: polymethylmethacrylate (Elvacite 2010, trade name, produced by Du Pont Co.)

Polyester: Byron 200, trade name, produced by Toyobo Co.

(I-54)

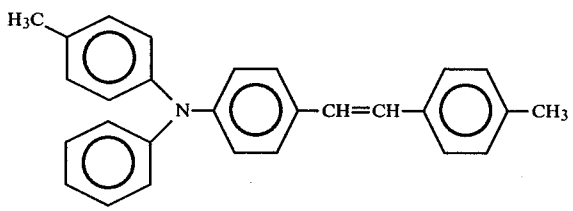

TABLE 3-continued
(V-23)
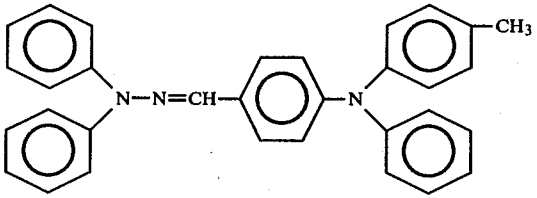
(II-1)
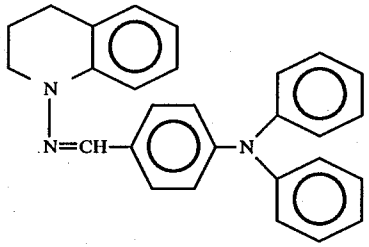
(I-77)
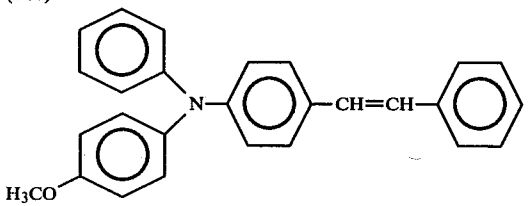
(II-14)
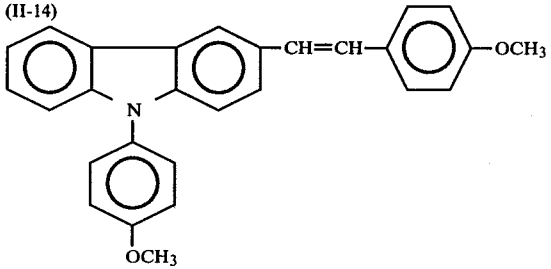

EXAMPLES 20 to 43

On an electroconductive support comprising a polyester film laminated with an aluminum foil, an intermediate layer comprising a vinyl chloride-vinyl acetate-maleic anhydride copolymer "Esrec MF-10" (produced by Sekisui Kagaku Co.) with a thickness of 0.05 μm was formed. Subsequently, a solution of the carrier transport substance and the binder resin as shown in Table 3 dissolved in 67 ml of 1,2-dichloroethane was applied on the above intermediate layer to form a carrier transporting layer.

Next, a dispersion obtained by dispersing the brominated anthanthrone and each carrier transporting substance as shown in Table 4 together with a binder resin in 67 ml of 1,2-dichloroethane by means of a ball mill for 12 hours was applied and dried on the above carrier transporting layer to form a carrier generating layer. Thus, respective electrophotographic photosensitive members were prepared.

The samples and comparative samples obtained in the above Examples and Comparative examples were mounted on a photoreceptor tester (produced by Konishiroku Photo Industry Co.) and, by use of a surface potentiometer "Electrostatic volt meter 144D-1D model" (produced by Monroe Electronics Inc.), the charging potential Vo (V), the exposure dose $E_{100}^{600}$ (lx sec) necessary for reducing the surface potential from +600 V to +100 V and the potential retentivity DD (%) after 5 seconds after the surface potential was made +600 V were examined.

Also, repeated test for 5000 times was performed for examination of stability of the charging potential.

For samples of which charging potential was less than 600 V, the charging current was increased than the standard value and $E_{100}^{600}$ and DD were measured thereat.

The results are shown in Table 5.

From these results, it can be understood that every one of the samples of the Examples based on the present inention (No. 20 to No. 40) has higher sensitivity and lower residual potential as compared with Comparative examples No. 6 to 7, and is also good in potential stability, thus exhibiting considerably good electrophotographic characteristics.

It can also be understood that it is desirable to select the ratio of the carrier transporting substance/carrier generating substance at 0.2 to 3.0, further at 0.4 to less than 2.0. Further, it can be seen that in spite of much amount of the carrier generating substance, electrophotographic characteristics are good and stability with lapse of time is excellent.

When the sensitivities of the photoreceptors of Example 31 and Comparative example 6 were measured under the comdition of 10° C., as shown below, it has been found that the sample based on the presint invention is little lowered in sensitivity even under low temperature condition, thus being good in temperature stability.

$E_{100}^{600}$ (10° C.): Example 31: 7.4 lux sec; Comparative example 6: 18.2 lux sec.

TABLE 4

| | Physical properties of brominated anthanthrone | | | | Preparation condition of brominated anthanthrone | | Carrier generating layer | | | | |
|---|---|---|---|---|---|---|---|---|---|---|---|
| | Δθ (18.4°) | Δθ (26.7°) | b/a | b (μm) | Ball mill rotation number | Pulverization time (hr) | Amount of carrier generating substance | Carrier transporting substance and amount thereof (g) | Carrier transporting substance/carrier generating substance | Binder and amount thereof (g) | Film thickness (μm) |
| Example 20 | 0.35 | 0.45 | 3.0 | 0.4 | 40 | 2 | 2.0 g | I-54 0.4 | 0.2 | B-1 4 | 5 |
| Example 21 | 0.35 | 0.45 | 3.0 | 0.4 | 40 | 2 | 2.0 g | I-54 0.8 | 0.4 | B-1 4 | 5 |
| Example 22 | 0.35 | 0.45 | 3.0 | 0.4 | 40 | 2 | 2.0 g | I-54 2.0 | 1.0 | B-1 4 | 5 |
| Example 23 | 0.35 | 0.45 | 3.0 | 0.4 | 40 | 2 | 2.0 g | I-54 3.0 | 1.5 | B-1 4 | 5 |
| Example 24 | 0.35 | 0.45 | 3.0 | 0.4 | 40 | 2 | 2.0 g | I-54 4.0 | 2.0 | B-1 4 | 5 |
| Example 25 | 0.35 | 0.45 | 3.0 | 0.4 | 40 | 2 | 2.0 g | I-54 6.0 | 3.0 | B-1 4 | 5 |
| Example 26 | 0.25 | 0.35 | 3.0 | 0.8 | 40 | 2 | 2.0 g | I-54 3.0 | 1.5 | B-1 4 | 5 |
| Example 27 | 0.51 | 0.65 | 3.0 | 0.7 | 40 | 3 | 2.0 g | I-54 3.0 | 1.5 | B-1 4 | 5 |
| Example 28 | 0.75 | 0.85 | 3.0 | 0.6 | 40 | 4 | 2.0 g | I-54 3.0 | 1.5 | B-1 4 | 5 |
| Example 29 | 0.40 | 0.51 | 3.0 | 0.5 | 70 | 10 | 2.0 g | V-23 3.0 | 1.5 | B-1 4 | 0.6 |
| Example 30 | 0.40 | 0.51 | 3.0 | 0.5 | 70 | 10 | 2.0 g | V-23 3.0 | 1.5 | B-1 4 | 1.0 |
| Example 31 | 0.40 | 0.51 | 3.0 | 0.5 | 70 | 10 | 2.0 g | V-23 3.0 | 1.5 | B-1 4 | 6.0 |
| Example 32 | 0.40 | 0.51 | 3.0 | 0.5 | 70 | 10 | 2.0 g | V-23 3.0 | 1.5 | B-1 4 | 8.0 |
| Example 33 | 0.40 | 0.51 | 3.0 | 0.5 | 70 | 10 | 2.0 g | V-23 3.0 | 1.5 | B-1 4 | 10.0 |
| Example 34 | 0.35 | 0.45 | 1.1 | 0.2 | 40 | 2 | 2.0 g | III-1 3.0 | 1.5 | B-1 4 | 2.0 |
| Example 35 | 0.35 | 0.45 | 2.0 | 0.4 | 40 | 2 | 2.0 g | III-1 3.0 | 1.5 | B-1 4 | 2.0 |
| Example 36 | 0.35 | 0.45 | 5.0 | 1.1 | 40 | 2 | 2.0 g | III-1 3.0 | 1.5 | B-1 4 | 2.0 |
| Example 37 | 0.35 | 0.45 | 10.0 | 2.2 | 40 | 2 | 2.0 g | III-1 3.0 | 1.5 | B-1 4 | 2.0 |
| Example 38 | 0.35 | 0.45 | 15.0 | 3.5 | 40 | 2 | 2.0 g | III-1 3.0 | 1.5 | B-1 4 | 2.0 |
| Example 39 | 0.35 | 0.45 | 20.0 | 5.0 | 40 | 2 | 2.0 g | III-1 3.0 | 1.5 | B-1 4 | 2.0 |
| Example 40 | 0.35 | 0.45 | 3.0 | 0.4 | 40 | 2 | 2.0 g | III-1 3.0 | 1.5 | B-2 4 | 5 |
| Example 41 | 0.35 | 0.45 | 3.0 | 0.4 | 40 | 2 | 2.0 g | III-1 3.0 | 1.5 | B-3 4 | 5 |
| Comparative example 6 | 1.0 | 1.1 | 1.2 | 0.1 | 40 | 10 | 2.0 g | I-54 3.0 | 1.5 | B-3 4 | 5 |
| Comparative example 7 | 0.85 | 0.98 | 1.2 | 0.1 | 40 | 8 | 2.0 g | I-54 3.0 | 1.5 | B-3 4 | 5 |
| Example 42 | 0.51 | 0.65 | 3.0 | 0.4 | 40 | 6 | 2.0 g | I-54 0.2 | 0.1 | B-3 4 | 5 |
| Example 43 | 0.51 | 0.65 | 3.0 | 0.4 | 40 | 6 | 2.0 g | I-54 8.0 | 4.0 | B-3 4 | 5 |
| | | | | | | | Carrier transporting layer | | | | |
| | | | | | | | Amount of carrier transporting substance (g) | Binder and amount thereof (g) | | | Film thickness (μm) |

TABLE 4-continued

| | | | |
|---|---|---|---|
| Example 20 | I-54 7.5 | B-1 10 | 15 |
| Example 21 | I-54 7.5 | B-1 10 | 15 |
| Example 22 | I-54 7.5 | B-1 10 | 15 |
| Example 23 | I-54 7.5 | B-1 10 | 15 |
| Example 24 | I-54 7.5 | B-1 10 | 15 |
| Example 25 | I-54 7.5 | B-1 10 | 15 |
| Example 26 | I-54 7.5 | B-1 10 | 15 |
| Example 27 | I-54 7.5 | B-1 10 | 15 |
| Example 28 | I-54 7.5 | B-1 10 | 15 |
| Example 29 | V-23 7.5 | B-1 10 | 15 |
| Example 30 | V-23 7.5 | B-1 10 | 15 |
| Example 31 | V-23 7.5 | B-1 10 | 15 |
| Example 32 | V-23 7.5 | B-1 10 | 15 |
| Example 33 | V-23 7.5 | B-1 10 | 15 |
| Example 34 | III-1 7.5 | B-1 10 | 15 |
| Example 35 | III-1 7.5 | B-1 10 | 15 |
| Example 36 | III-1 7.5 | B-1 10 | 15 |
| Example 37 | III-1 7.5 | B-1 10 | 15 |
| Example 38 | III-1 7.5 | B-1 10 | 15 |
| Example 39 | III-1 7.5 | B-1 10 | 15 |
| Example 40 | III-1 7.5 | B-2 10 | 15 |
| Example 41 | III-1 7.5 | B-3 10 | 15 |
| Comparative example 6 | I-54 7.5 | B-3 10 | 15 |
| Comparative example 7 | I-54 7.5 | B-3 10 | 15 |
| Example 42 | I-54 7.5 | B-3 10 | 15 |
| Example 43 | I-54 7.5 | B-3 10 | 15 |

Carrier generating substance (brominated anthanthrone) in Examples 29–33 prepared by the sublimation purification method, other examples by the chemical purification method.
B-1: polycarbonate (Panlite L-1250, trade name, produced by Teijin Kasei)
B-2: polymethylmethacrylate (Elvacite 2010, trade name, produced by Du Pont Co.)
B-3: polyester (Byron 200, trade name, produced by Toyobo Co.)

TABLE 5

| | Surface potential | | | | DD % |
|---|---|---|---|---|---|
| | Initial | After 5000 copies | Quality lowered | $E_{100}^{600}$ (25° C.) (lux · sec) | (potential retentivity) |
| Example 20 | +680 | +660 | 20 | 8.5 | 88 |
| Example 21 | +685 | +670 | 15 | 8.3 | 87 |
| Example 22 | +680 | +655 | 25 | 8.2 | 84 |
| Example 23 | +690 | +660 | 30 | 8.2 | 82 |
| Example 24 | +705 | +675 | 30 | 8.1 | 79 |
| Example 25 | +670 | +650 | 20 | 8.0 | 77 |
| Example 26 | +680 | +655 | 25 | 8.3 | 82 |
| Example 27 | +685 | +650 | 35 | 8.2 | 80 |
| Example 28 | +675 | +640 | 35 | 8.0 | 81 |
| Example 29 | +620 | +590 | 30 | 9.2 | 83 |
| Example 30 | +630 | +595 | 35 | 8.5 | 84 |
| Example 31 | +725 | +690 | 35 | 7.0 | 86 |
| Example 32 | +760 | +735 | 25 | 7.3 | 85 |
| Example 33 | +805 | +770 | 35 | 7.5 | 83 |
| Example 34 | +625 | +590 | 35 | 7.4 | 85 |
| Example 35 | +620 | +590 | 30 | 7.6 | 82 |
| Example 36 | +630 | +595 | 35 | 7.8 | 75 |
| Example 37 | +625 | +605 | 20 | 7.7 | 76 |
| Example 38 | +615 | +595 | 20 | 8.0 | 72 |
| Example 39 | +610 | +575 | 35 | 8.1 | 79 |
| Example 40 | +660 | +640 | 20 | 8.4 | 82 |
| Example 41 | +665 | +650 | 15 | 8.6 | 84 |
| Comparative example 6 | +670 | +595 | 75 | 14.5 | 58 |
| Comparative example 7 | +675 | +590 | 85 | 12.2 | 60 |
| Example 42 | +660 | +570 | 90 | 10.5 | 78 |
| Example 43 | +680 | +605 | 75 | 10.1 | 80 |

We claim:

1. A photoreceptor comprising a brominated anthanthrone pigment represented by the structural formula:

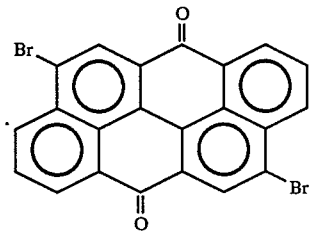

contained in the photosensitive layer, said brominated anthanthrone pigment exhibiting an X-ray diffraction spectrum having the respective diffraction strengths S (18.4°) and S (26.7°) at $2\theta = 18.4°$ and 26.7° which satisfy the relationship of $$0.2 \leqq S(18.4°)/S(26.7°) \leqq 1.0,$$

and having a respective half-value width of diffraction strength which satisfies the relationship of $$\{\Delta\theta(18.4°) \leqq 0.8\} \text{ or } \{\Delta\theta(26.7°) \leqq 1\}.$$

2. A photoreceptor according to claim 1, wherein particle shape of said brominated anthanthrone has b/a $\geqq$ 1.1 when a short axis length is defined as a and a long axis length as b.

3. A photoreceptor comprising a brominated anthanthrone pigment represented by the structural formula shown below:

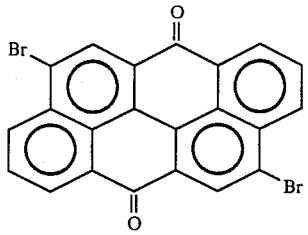

contained in the photosensitive layer, said brominated anthanthrone pigment exhibiting a X-ray diffraction spectrum having the respective half-value width of diffraction strengths $\Delta\theta(18.4°)$ and $\Delta\theta(26.7°)$ at $2\theta=18.4°$ and 26.7° which satisfy the relationship of $$\{\Delta\theta(18.4°)\leqq 0.8°\} \text{ or } \{\Delta\theta(26.7°)\leqq 1°\}.$$

4. A photoreceptor according to claim 3, wherein particle shape of said brominated anthanthrone has b/a $\geqq$ 1.1 when a short axis length is defined as a and a long axis length as b.

5. A photoreceptor according to claim 4, wherein said a and b satisfies the relationship of $1.5 \leqq b/a \leqq 15$.

6. A photoreceptor according to claim 4, wherein said long axis length is 2 $\mu$m or less.

7. A photoreceptor having a carrier transporting layer and a carrier generating layer laminated successively on a support, said carrier generating layer containing a brominated anthanthrone represented by the structural formula:

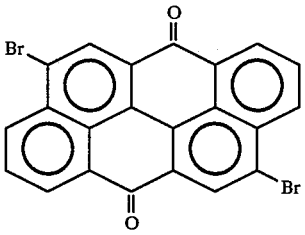

a carrier transporting substance and a binder resin, the content of said brominated anthanthrone in said carrier generating layer being 10 to 300 parts by weight per 100 parts by weight of said binder resin, the content of said carrier transporting substance in said carrier generating layer being 20 to 200 parts by weight per 100 parts by weight of said binder resin, and the ratio of said carrier transporting substance to said brominated anthanthrone being 0.2 to 3.0 in terms of weight ratio, said brominated anthanthrone pigment exhibiting an X-ray diffraction spectrum having the respective half-value widths of diffraction strength of $\Delta\theta(18.4°)$ and $\Delta\theta(26.7°)$ at $2\theta=18.4°$ and 26.7° which satisfy the relationship of $$\{\Delta\theta(18.4°)\leqq 0.8°\} \text{ or } \{\Delta\theta(26.7°)\leqq 1°\}.$$

8. A photoreceptor according to claim 7, wherein the ratio of said brominated anthanthrone:said carrier transporting substance is 1:0.2 to 3.

9. A photoreceptor according to claim 7, wherein said brominated anthanthrone pigment exhibiting a X-ray diffraction spectrum having the respective diffraction strengths S (18.4°) and S (26.7°) at $2\theta=18.4°$ and 26.7° which satisfy the relationship of $$0.2\leqq S(18.4°)/S(26.7°)\leqq 1.0.$$

10. A photoreceptor according to claim 9, wherein the ratio of said brominated anthanthrone:said carrier transporting substance is 1:0.2 to 3.

11. A photoreceptor according to claim 7, wherein particle shape of said brominated anthanthrone has b/a $\geqq$ 1.1 when a short axis length is defined as a and a long axis length as b.

12. A photoreceptor according to claim 11, wherein the ratio of said brominated anthanthrone:said carrier transporting substance is 1:0.2 to 3.

13. A photoreceptor according to claim 11, wherein said a and b satisfies the relationship of $1.5\leqq b/a \leqq 15$.

14. A photoreceptor according to claim 13, wherein the ratio of said brominated anthanthrone:said carrier transporting substance is 1:0.2 to 3.

15. A photoreceptor according to claim 11, wherein said long axis length is 2 $\mu$m or less.

16. A photoreceptor according to claim 15, wherein the ratio of said brominated anthanthrone:said carrier transporting substance is 1:0.2 to 3.

17. A photoreceptor according to claim 7, wherein said carrier transporting layer is applied by coating a dispersion thereof on said support.

* * * * *